US010539351B2

(12) United States Patent
Ignatiev et al.

(10) Patent No.: US 10,539,351 B2
(45) Date of Patent: Jan. 21, 2020

(54) COMPRESSOR WITH FLUID CAVITY FOR COOLING

(71) Applicant: Emerson Climate Technologies, Inc., Sidney, OH (US)

(72) Inventors: Kirill M. Ignatiev, Sidney, OH (US); Robert C. Stover, Versailles, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 314 days.

(21) Appl. No.: 15/426,983

(22) Filed: Feb. 7, 2017

(65) Prior Publication Data

US 2017/0198696 A1 Jul. 13, 2017

Related U.S. Application Data

(63) Continuation of application No. 14/172,234, filed on Feb. 4, 2014, now Pat. No. 9,562,709.

(Continued)

(51) Int. Cl.

*F03C 2/00* (2006.01)
*F03C 4/00* (2006.01)

(Continued)

(52) U.S. Cl.

CPC ..... *F25B 43/02* (2013.01); *F04B 39/06* (2013.01); *F04B 39/066* (2013.01); *F04C 2/344* (2013.01);

(Continued)

(58) Field of Classification Search

CPC .. F04C 18/0215; F04C 18/0261; F04C 2/344; F04C 29/0085; F04C 29/04; F04C 29/12;

(Continued)

(56) References Cited

U.S. PATENT DOCUMENTS 2,510,887 A 6/1950 Hanson
3,352,124 A 11/1967 Watkins (Continued)

FOREIGN PATENT DOCUMENTS

CN 101307962 A 11/2008
CN 101568776 A 10/2009

(Continued)

OTHER PUBLICATIONS

JPH0510278A—Ukai et al.—Scroll Type Compressor—Jan. 19, 1993—English Translation (Year: 1993).*

(Continued)

*Primary Examiner* — Theresa Trieu
(74) *Attorney, Agent, or Firm* — Harness, Dickey & Pierce, P.L.C.

(57) ABSTRACT

A system may include a compressor including a compression mechanism having first and second compression members defining a compression pocket disposed between the first and second compression members that decreases in volume during operation of the compression mechanism. A heat exchanger receives compressed working fluid from the compressor. An expansion device may be disposed downstream of the heat exchanger. A lubricant separator receives lubricant and working fluid discharged from the compression mechanism and provides separated lubricant to the compression mechanism. A lubricant-injection flow path may include a lubricant fitting and extends between the lubricant separator and the compression pocket such that separated lubricant is injected into the compression pocket through the lubricant fitting.

9 Claims, 12 Drawing Sheets

Related U.S. Application Data

(60) Provisional application No. 61/779,689, filed on Mar. 13, 2013, provisional application No. 61/760,882, filed on Feb. 5, 2013.

(51) Int. Cl.

| | |
|---|---|
| ***F04C 18/00*** | (2006.01) |
| ***F04C 2/00*** | (2006.01) |
| ***F25B 43/02*** | (2006.01) |
| ***F25B 6/04*** | (2006.01) |
| ***F25B 40/04*** | (2006.01) |
| ***F25B 31/00*** | (2006.01) |
| ***F25B 6/02*** | (2006.01) |
| ***F25B 1/10*** | (2006.01) |
| ***F25B 40/00*** | (2006.01) |
| ***F25B 41/04*** | (2006.01) |
| ***F04B 39/06*** | (2006.01) |
| ***F04C 2/344*** | (2006.01) |
| ***F04C 18/02*** | (2006.01) |
| ***F04C 29/04*** | (2006.01) |
| ***F04C 29/00*** | (2006.01) |
| ***F04C 29/12*** | (2006.01) |
| ***F25B 1/04*** | (2006.01) |
| ***F25B 13/00*** | (2006.01) |
| ***F25B 31/02*** | (2006.01) |
| ***F25B 40/06*** | (2006.01) |

(52) U.S. Cl.

CPC ..... *F04C 18/0215* (2013.01); *F04C 18/0261* (2013.01); *F04C 29/0085* (2013.01); *F04C 29/04* (2013.01); *F04C 29/12* (2013.01); *F25B 1/04* (2013.01); *F25B 1/10* (2013.01); *F25B 6/02* (2013.01); *F25B 6/04* (2013.01); *F25B 13/00* (2013.01); *F25B 31/004* (2013.01); *F25B 31/006* (2013.01); *F25B 31/026* (2013.01); *F25B 40/00* (2013.01); *F25B 40/04* (2013.01); *F25B 40/06* (2013.01); *F25B 41/04* (2013.01); *F04C 2240/30* (2013.01); *F04C 2240/40* (2013.01); *F25B 31/002* (2013.01); *F25B 31/008* (2013.01)

(58) Field of Classification Search

CPC .. F04C 2240/30; F04C 2240/40; F04B 39/06; F04B 39/066; F25B 1/04; F25B 1/10; F25B 6/02; F25B 6/04; F25B 13/00; F25B 31/002; F25B 31/004; F25B 31/006; F25B 31/008; F25B 31/026; F25B 40/00; F25B 40/04; F25B 40/06; F25B 41/04; F25B 43/02

USPC ..... 418/83, 55.1–55.6, 57, 270

See application file for complete search history.

(56) References Cited

U.S. PATENT DOCUMENTS

| | | | |
|---|---|---|---|
| 3,710,590 | A | 1/1973 | Kocher |
| 4,365,941 | A | 12/1982 | Tojo et al. |
| 4,382,370 | A | 5/1983 | Suefuji et al. |
| 5,140,828 | A | 8/1992 | Hagita et al. |
| 5,224,357 | A | 7/1993 | Galiyano et al. |
| 5,273,412 | A | 12/1993 | Zwaans |
| 6,058,727 | A | 5/2000 | Fraser, Jr. et al. |
| 6,464,467 | B2 | 10/2002 | Sullivan et al. |
| 8,037,712 | B2 | 10/2011 | Cho et al. |
| 2001/0027664 | A1 | 10/2001 | Ross |
| 2001/0043878 | A1 | 11/2001 | Sullivan et al. |
| 2004/0184932 | A1 | 9/2004 | Lifson |
| 2005/0086957 | A1 | 4/2005 | Lifson et al. |
| 2007/0130973 | A1 | 6/2007 | Lifson et al. |
| 2008/0256961 | A1 | 10/2008 | Lifson et al. |
| 2010/0077777 | A1 | 4/2010 | Lifson et al. |
| 2010/0307173 | A1 | 12/2010 | Guo et al. |

FOREIGN PATENT DOCUMENTS

| | | | |
|---|---|---|---|
| CN | 202065179 | U | 12/2011 |
| JP | H0510278 | A | 1/1993 |
| JP | H06159013 | A | 6/1994 |
| JP | H09236092 | A | 9/1997 |
| JP | 3640749 | B2 | 4/2005 |
| WO | WO-2009005574 | A1 | 1/2009 |
| WO | WO-2009128487 | A1 | 10/2009 |

OTHER PUBLICATIONS

Office Action regarding U.S. Appl. No. 14/172,155, dated Aug. 10, 2017.

Office Action regarding U.S. Appl. No. 14/172,155, dated Dec. 18, 2017.

Notice of Allowance regarding U.S. Appl. No. 14/172,155, dated May 23, 2018.

Office Action regarding Chinese Patent Application No. 201711420605.6, dated Dec. 11, 2018. Translation provided by Unitalen Attorneys at Law.

Office Action regarding Indian Patent Application No. 2225/MUMNP/2015, dated Jan. 7, 2019.

International Search Report regarding Application No. PCT/US2014/014646, dated May 15, 2014.

Written Opinion of the International Searching Authority regarding Application No. PCT/US2014/014646, dated May 15, 2014.

Office Action regarding U.S. Appl. No. 14/172,234, dated Sep. 11, 2015.

Restriction Requirement regarding U.S. Appl. No. 14/172,155, dated Oct. 23, 2015.

Office Action regarding U.S. Appl. No. 14/172,234, dated Feb. 1, 2016.

Office Action regarding U.S. Appl. No. 14/172,155, dated Feb. 12, 2016.

Search Report regarding European Patent Application No. 14749642.6, dated Jul. 1, 2016.

Office Action regarding U.S. Appl. No. 14/172,234, dated Aug. 17, 2016.

Office Action regarding Chinese Patent Application No. 201480013338.9, dated Aug. 3, 2016. Translation provided by Unitalen Attorneys at Law.

Office Action regarding U.S. Appl. No. 14/172,155, dated Oct. 11, 2016.

Office Action regarding Chinese Patent Application No. 201480013338.9, dated Apr. 5, 2017. Translation provided by Unitalen Attorneys at Law.

* cited by examiner

COMPRESSOR WITH FLUID CAVITY FOR COOLING

CROSS-REFERENCE TO RELATED APPLICATIONS

This application claims the benefit of U.S. application Ser. No. 14/172,234, filed on Feb. 4, 2014, now U.S. Pat. No. 9,562,709, U.S. Provisional Application No. 61/760,882, filed on Feb. 5, 2013 and U.S. Provisional Application No. 61/779,689, filed on Mar. 13, 2013. The entire disclosure of each of the above applications is incorporated herein by reference.

FIELD

The present disclosure relates to a compressor cooling system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, a system may include a compressor including a compression mechanism having first and second compression members defining a compression pocket disposed between the first and second compression members that decreases in volume during operation of the compression mechanism. A heat exchanger receives compressed working fluid from the compressor. An expansion device may be disposed downstream of the heat exchanger. A lubricant separator receives lubricant and working fluid discharged from the compression mechanism and provides separated lubricant to the compression mechanism. A lubricant-injection flow path may include a lubricant fitting and extends between the lubricant separator and the compression pocket such that separated lubricant is injected into the compression pocket through the lubricant fitting.

In some embodiments, the present disclosure provides a system that may include a compressor, an expansion device, first and second heat exchangers, first and second working fluid flow paths, and a pump. The compressor may include first and second inlets and an outlet. The first heat exchanger may receive compressed working fluid from the outlet of the compressor. The expansion device may be disposed downstream of the first heat exchanger. The first working fluid flow path may fluidly connect the first heat exchanger and the expansion device. The second working fluid flow path may fluidly connect the first heat exchanger with the first inlet of the compressor. The first inlet may be fluidly isolated from a compression chamber of the compressor. The second heat exchanger may receive working fluid from the expansion device and may provide working fluid to the second inlet of the compressor. The pump may be disposed between the first heat exchanger and the expansion device. The pump may include an inlet and first and second outlets. The first outlet may be fluidly connected to the first working fluid flow path. The second outlet may be fluidly connected to the second working fluid flow path.

In some embodiments, the pump includes a rotor powered by a pressure differential between the inlet and the first outlet.

In some embodiments, the pump includes a rotary vane pump.

In some embodiments, the compressor includes a shell, a compression mechanism disposed within the shell, and a motor disposed within the shell. The first inlet of the compressor may extend through the shell and provide compressed working fluid to at least one of the compression mechanism and the motor.

In some embodiments, the compression mechanism includes first and second scrolls defining the compression chamber therebetween. One of the first and second scrolls may include a fluid cavity in communication with the first inlet and may receive compressed working fluid from the first inlet.

In some embodiments, the shell defines a discharge chamber in communication with the compression chamber and the fluid cavity and receives compressed working fluid from the compression chamber and the fluid cavity.

In some embodiments, the compressor includes a third heat exchanger disposed within the shell and in a heat transfer relationship with the motor. The third heat exchanger may be in communication with the second working fluid flow path and may receive compressed working fluid from the second working fluid flow path.

In some embodiments, the shell defines a discharge chamber in communication with the compression chamber, the fluid cavity and the third heat exchanger. The discharge chamber may receive compressed working fluid from the compression pocket, the fluid cavity and the third heat exchanger.

In some embodiments, a first fluid pressure at the inlet of the pump is higher than a second fluid pressure at the first outlet of the pump. A third fluid pressure at the second outlet of the pump may be greater than the first and second fluid pressures.

In some embodiments, the system includes a bypass conduit extending between the first and second working fluid flow paths and providing fluid communication therebetween. The bypass conduit may include a valve controlling fluid flow through the bypass conduit.

In some embodiments, the system includes a third heat exchanger disposed between the second outlet of the pump and the compressor.

In some embodiments, the third heat exchanger receives a lubricant from a lubricant sump of the compressor and working fluid from the second outlet of the pump. The working fluid and the lubricant may be fluidly isolated from each other in the third heat exchanger and in a heat transfer relationship with each other in the third heat exchanger.

In some embodiments, the system is a heat pump system.

In some embodiments, the system includes first and second valve groupings disposed between the first and second heat exchangers. Each of the first and second valve groupings may include an expansion device and a control valve.

In another form, the present disclosure provides a system that may include a compressor, a heat exchanger, an expansion device, and first and second working fluid flow paths. The compressor may include a compression mechanism and a motor. The heat exchanger may receive compressed working fluid from the compressor. The expansion device may be disposed downstream of the heat exchanger. The first working fluid flow path may fluidly connect the heat exchanger and the expansion device. The second working fluid flow path may be disposed downstream of the heat exchanger and may fluidly connect the heat exchanger with the compressor. The second working fluid flow path may provide compressed working fluid to the compression mechanism and to the motor.

In some embodiments, the compressor includes a shell in which the compression mechanism is disposed. The shell may include a first inlet extending therethrough and communicating compressed working fluid from the second fluid flow path to at least one of the compression mechanism and the motor.

In some embodiments, the compression mechanism includes first and second compression members defining a compression chamber therebetween. One of the first and second compression members may include a fluid cavity in communication with the first inlet and receiving compressed working fluid from the first inlet.

In some embodiments, the first and second compression members include first and second scrolls.

In some embodiments, the shell defines a discharge chamber in communication with the compression chamber and the fluid cavity and receiving compressed working fluid from the compression chamber and the fluid cavity.

In some embodiments, the compressor includes a second heat exchanger disposed within the shell and in a heat transfer relationship with the motor. The second heat exchanger may be in communication with the second fluid flow path and may receive compressed working fluid from the second fluid flow path.

In some embodiments, the compression mechanism includes first and second compression members defining a compression chamber therebetween. One of the first and second compression members may include a fluid cavity in communication with the second fluid flow path and receiving compressed working fluid from the second fluid flow path.

In some embodiments, the shell defines a discharge chamber in communication with the compression chamber, the fluid cavity and the second heat exchanger. The discharge chamber may receive compressed working fluid from the compression chamber, the fluid cavity and the second heat exchanger.

In some embodiments, the shell defines a suction chamber in communication with the compression chamber and containing suction-pressure working fluid that is isolated from compressed working fluid in the fluid cavity and compressed working fluid in the second heat exchanger.

In another form, the present disclosure provides a compressor that may include a shell, a compression mechanism, a motor and a heat exchanger. The shell may include a first inlet, a second inlet and an outlet. The compression mechanism may be disposed within the shell and may include a compression chamber receiving fluid from the first inlet. The motor may be disposed within the shell and may power the compression mechanism. The heat exchanger may be disposed within the shell and may be in a heat transfer relationship with the motor. The heat exchanger may receive fluid from the second inlet.

In some embodiments, the compression mechanism includes a fluid cavity that is fluidly isolated from the compression chamber.

In some embodiments, the fluid cavity is in communication with the second inlet.

In some embodiments, the fluid cavity is in communication with a discharge-pressure chamber disposed within the shell. The discharge-pressure chamber may be communication with the compression chamber.

In some embodiments, the heat exchanger is in communication with the discharge-pressure chamber.

In another form, the present disclosure provides a compressor that may include a shell, first and second scrolls, and a motor. The shell may define a discharge-pressure chamber and may include first and second inlets and an outlet. The first scroll may be disposed within the discharge-pressure chamber. The second scroll may be disposed within the discharge-pressure chamber and may be meshingly engaged with the first scroll to define a compression pocket therebetween. The first inlet may be in communication with the compression pocket and may be fluidly isolated from fluid in the discharge-pressure chamber. The second scroll may include a fluid cavity in communication with the second inlet and fluidly isolated from fluid within the compression pocket. The motor may be disposed within the discharge-pressure chamber and may drive one of the first and second scrolls.

In some embodiments, the shell includes a third inlet providing fluid to the motor.

In some embodiments, the third inlet is disposed vertically above the motor.

In some embodiments, the compressor includes a fluid distribution member disposed vertically between the third inlet and the motor.

In some embodiments, the fluid distribution member includes an annular plate having a plurality of apertures extending therethrough.

In another form, the present disclosure provides a system that may include a compressor, a heat exchanger, an expansion device, a lubricant separator, and a flow path. The compressor includes a compression mechanism. The heat exchanger receives compressed working fluid from the compressor. The expansion device is disposed downstream of the heat exchanger. The lubricant separator receives lubricant and working fluid discharged from the compression mechanism and provides separated lubricant to the compression mechanism. The flow path may receive working fluid from the heat exchanger and may provide working fluid to the heat exchanger without flowing through the compressor. The flow path may extend between a first location disposed between the heat exchanger and the expansion device and a second location disposed upstream of the heat exchanger and between the heat exchanger and the compressor. The working fluid from the flow path may absorb heat from the separated lubricant.

In some embodiments, the working fluid from the flow path is in a heat transfer relationship with the separated lubricant at a location upstream from a lubricant inlet of the compressor.

In some embodiments, the working fluid from the flow path is in a heat transfer relationship with the separated lubricant at a location upstream from the compression mechanism.

In some embodiments, the working fluid from the flow path is in a heat transfer relationship with the separated lubricant at a location between the lubricant separator and the compression mechanism.

In some embodiments, the working fluid from the flow path is in a heat transfer relationship with the separated lubricant within the lubricant separator.

In some embodiments, the heat transfer relationship includes direct contact between the separated lubricant and the working fluid from the flow path.

In some embodiments, the lubricant separator includes first and second inlets and first and second outlets.

In some embodiments, the first inlet receives a mixture of lubricant and working fluid from the compression mechanism; the second inlet receives condensed working fluid from the heat exchanger; the first outlet provides separated working fluid to the heat exchanger; and the second outlet provides separated lubricant to the compression mechanism.

In some embodiments, the system includes a pump disposed in the flow path.

In some embodiments, the flow path includes another heat exchanger in which the separated lubricant and condensed working fluid are in the heat transfer relationship.

In another form, the present disclosure provides a system that may include a compressor, a lubricant-injection flow path, a heat exchanger, an expansion device and a recirculation flow path. The compressor includes a compression mechanism. The lubricant separator is in communication with the compression mechanism. The lubricant-injection flow path may extending between the lubricant separator and a compression pocket of the compression mechanism. The heat exchanger may be in communication with the lubricant separator and may receive working fluid from the lubricant separator. The expansion device may be disposed downstream of the heat exchanger. The recirculation flow path may provide condensed working fluid from the heat exchanger in a heat transfer relationship with separated lubricant from the lubricant separator. The condensed working fluid may have a first fluid pressure higher than a second fluid pressure of working fluid exiting the expansion device.

In some embodiments, the working fluid from the recirculation flow path is in the heat transfer relationship with the separated lubricant at a location upstream from a lubricant inlet of the compressor.

In some embodiments, the working fluid from the recirculation flow path is in the heat transfer relationship with the separated lubricant at a location upstream from the compression mechanism.

In some embodiments, the working fluid from the recirculation flow path is in the heat transfer relationship with the separated lubricant at a location between the lubricant separator and the compression mechanism.

In some embodiments, the working fluid from the recirculation flow path is in the heat transfer relationship with the separated lubricant within the lubricant separator.

In some embodiments, the heat transfer relationship includes direct contact between the separated lubricant and the working fluid from the recirculation flow path.

In some embodiments, the lubricant separator includes first and second inlets and first and second outlets.

In some embodiments, the first inlet receives a mixture of lubricant and working fluid from the compression mechanism; the second inlet receives the condensed working fluid from the heat exchanger; the first outlet provides separated working fluid to the heat exchanger; and the second outlet provides separated lubricant to the compression mechanism.

In some embodiments, the system includes a pump disposed in the recirculation flow path.

In some embodiments, the recirculation flow path includes another heat exchanger in which the separated lubricant and the condensed working fluid are in the heat transfer relationship.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
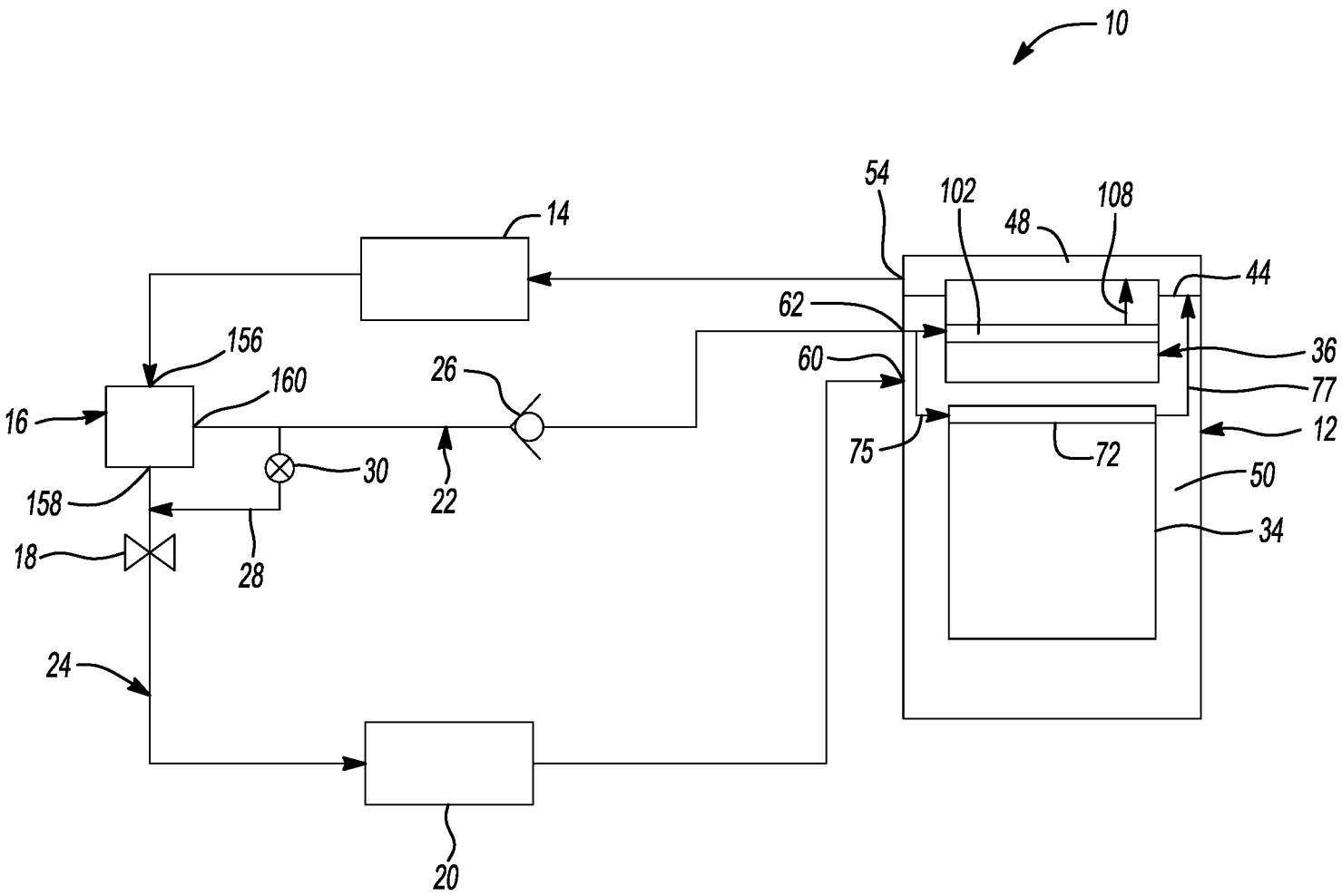
FIG. 1 is a schematic representation of a climate control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a fluid circuit 10 is provided that may include a compressor 12, a first heat exchanger 14, a pump 16, an expansion device 18, and a second heat exchanger 20. The compressor 12 may circulate a working fluid (e.g., refrigerant, carbon dioxide, etc.) throughout the fluid circuit 10. The first heat exchanger 14 may operate as a condenser or as a gas cooler and may cool discharge-pressure working fluid received from the compressor 12 by transferring heat from the working fluid to ambient air, for example. The expansion device 18 (e.g., an expansion valve, a capillary tube, etc.) may be disposed downstream from the first heat exchanger 14 and expands the working fluid passing therethrough. The second heat exchanger 20 may operate as an evaporator. Heat from a space to be cooled may be absorbed by the working fluid in the second heat exchanger 20. The compressor 12 may receive suction-pressure working fluid from the second heat exchanger 20.

The fluid circuit 10 may include first and second working fluid flow paths 22, 24. The first working fluid flow path 22 may extend from the pump 16 to the compressor 12. The second working fluid flow path 24 may extend from the pump 16, through the expansion device 18 and through the second heat exchanger 20 to the compressor 12. The first working fluid flow path 22 may include a check valve 26 between the pump 16 and the compressor 12 to restrict or prevent a reverse-flow condition through the first working fluid flow path 22. A bypass conduit 28 may extend from the first working fluid flow path 22 to the second working fluid flow path 24 and may include a control valve 30 to control fluid flow therethrough.

Figure 2:
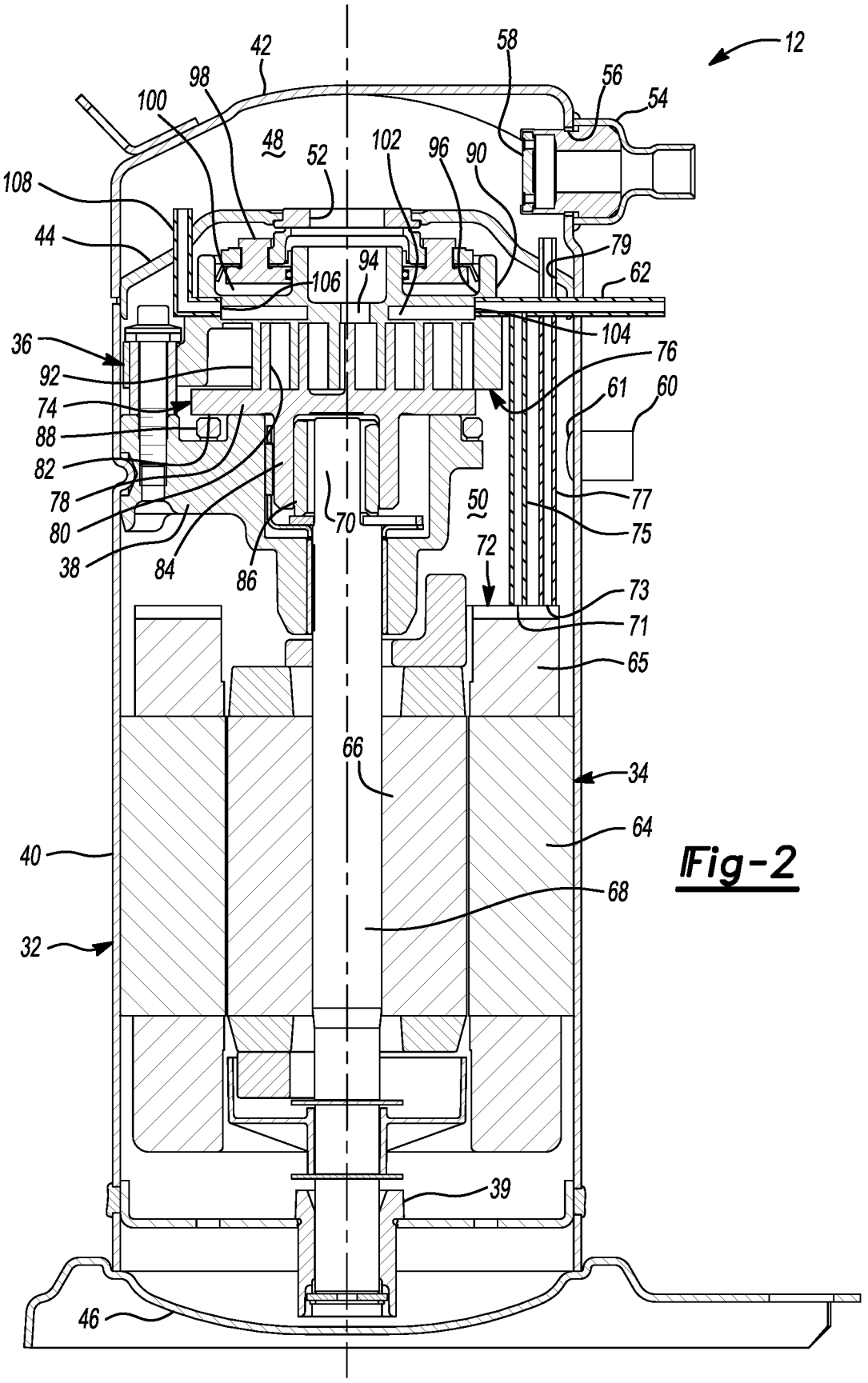
FIG. 2 is a cross-sectional view of a compressor of the climate control system of FIG. 1.

Referring now to FIGS. 1 and 2, the compressor 12 may be a low-side compressor including a hermetic shell assembly 32, a motor assembly 34, a compression mechanism 36, a first bearing assembly 38, and a second bearing assembly 39.

The shell assembly 32 may form a compressor housing and may include a cylindrical shell 40, an end cap 42 at an upper end thereof, a transversely extending partition 44, and a base 46 at a lower end thereof. The end cap 42 and the partition 44 may define a discharge chamber 48. The partition 44 may separate the discharge chamber 48 from a suction chamber 50. The partition 44 may define a discharge passage 52 extending therethrough to provide communication between the compression mechanism 36 and the discharge chamber 48. A discharge fitting 54 may be attached to shell assembly 32 at an opening 56 in the end cap 42. A discharge valve assembly 58 may be disposed within the discharge fitting 54 or proximate the discharge passage 52 and may generally prevent a reverse flow condition through the discharge fitting 54. A suction inlet fitting 60 may be attached to shell assembly 32 at an opening 61 and may receive suction-pressure working fluid from the second working fluid flow path 24. A compressed-fluid inlet 62 may extend through the shell assembly 32 and may fluidly couple the first working fluid flow path 22 with the compression mechanism 36, as will be described in more detail below.

The motor assembly 34 may include a motor stator 64, windings 65, a rotor 66, and a drive shaft 68. The motor stator 64 may be press fit into the shell 40, for example, or otherwise secured thereto. The rotor 66 may be press fit on the drive shaft 68 and may transmit rotational power to the drive shaft 68. The drive shaft 68 may be rotatably supported by the first and second bearing assemblies 38, 39. The drive shaft 68 may include an eccentric crank pin 70.

A heat exchanger 72 (shown schematically in FIGS. 1 and 2) may be attached to the stator 64 and/or windings 65, for example, and may be in a heat transfer relationship therewith. It will be appreciated that the heat exchanger 72 could be the disposed at any suitable location within the compressor 12 for absorbing heat from the motor assembly 34, oil in an oil sump, and/or any other component of the compressor 12. The heat exchanger 72 can include a coiled pipe, for example, or any suitable fluid conduit and may include a working-fluid inlet 71 and a working-fluid outlet 73. A supply conduit 75 may fluidly connect the working-fluid inlet 71 with the compressed-fluid inlet 62 to enable compressed working fluid to flow from the first fluid flow path 22 to the heat exchanger 72. A discharge conduit 77 may fluidly connect the working-fluid outlet 73 with the discharge chamber 48. As shown in FIG. 2, the discharge conduit 77 may extend through an opening 79 in the partition 44.

The compression mechanism 36 may include an orbiting scroll 74 and a non-orbiting scroll 76. The orbiting scroll 74 may include an end plate 78 having a spiral wrap 80 on a first side thereof and an annular flat thrust surface 82 on a second side. The thrust surface 82 may interface with the first bearing assembly 38. A cylindrical hub 84 may project downwardly from the thrust surface 82. A drive bearing (not shown) may be disposed within the hub 84 and may receive a drive bushing 86. The crank pin 70 of the drive shaft 68 may drivingly engage the drive bushing 86. An Oldham coupling 88 may be engaged with the orbiting and non-orbiting scrolls 74, 76 to prevent relative rotation therebetween. The crank pin 70 may include a flat surface formed thereon that slidably engages a corresponding flat surface in the drive bushing 86 that engages the hub 84.

The non-orbiting scroll 76 may include an end plate 90 and a spiral wrap 92 projecting downwardly from the end plate 90. The spiral wrap 92 may meshingly engage the spiral wrap 80 of the orbiting scroll 74, thereby creating a series of moving fluid pockets (compression pockets) defined by the spiral wraps 80, 92 and end plates 78, 90. The compression mechanism 36 may draw suction-pressure fluid from the suction chamber 50 and suction inlet fitting 60 into the fluid pockets. The fluid pockets may decrease in volume as they move from a radially outer position (e.g., at a suction pressure) to a radially inner position (e.g., at a discharge pressure that is higher than the suction pressure) throughout a compression cycle of the compression mechanism 36. At the radially inner position, compressed working fluid exits the compression mechanism 36 through a discharge passage 94 and flows into the discharge chamber 48 and subsequently out of the compressor 12 through the discharge fitting 54.

The end plate 90 may include an annular recess 96 that may at least partially receive a floating seal assembly 98 and may cooperate with the seal assembly 98 to define an axial biasing chamber 100 therebetween. The biasing chamber 100 may receive intermediate-pressure fluid from a fluid pocket formed by the compression mechanism 36. A pressure differential between the intermediate-pressure fluid in the biasing chamber 100 and fluid in the suction chamber 50 exerts a net axial biasing force on the non-orbiting scroll 76 urging the non-orbiting scroll 76 toward the orbiting scroll 74 to facilitate a sealed relationship therebetween.

The end plate 90 may also include a fluid cavity 102 (shown schematically in FIGS. 1 and 2) disposed between the recess 96 and the spiral wrap 92, for example, and/or any other suitable location. The fluid cavity 102 can be an annular cavity, for example, and may include an inlet 104 and an outlet 106. The inlet 104 may be fluidly connected to the compressed-fluid inlet 62 to allow compressed working fluid to flow from the first working fluid flow path 22 to the fluid cavity 102. The outlet 106 may be fluidly connected to a discharge conduit 108 that is in fluid communication with the discharge chamber 48 to allow working fluid to flow from the fluid cavity 102 to the discharge chamber 48. In some embodiments, the discharge conduits 77, 108 may converge together as a single conduit prior to passing through the partition 44, thereby reducing the number of openings in the partition 44. In some embodiments, the fluid cavity could be configured such that the outlet 106 communicates with the discharge passage 94 (i.e., the fluid exiting the fluid cavity 102 may combine with fluid being discharged from the compression mechanism 36 in or adjacent the discharge passage 94).

Figure 3:
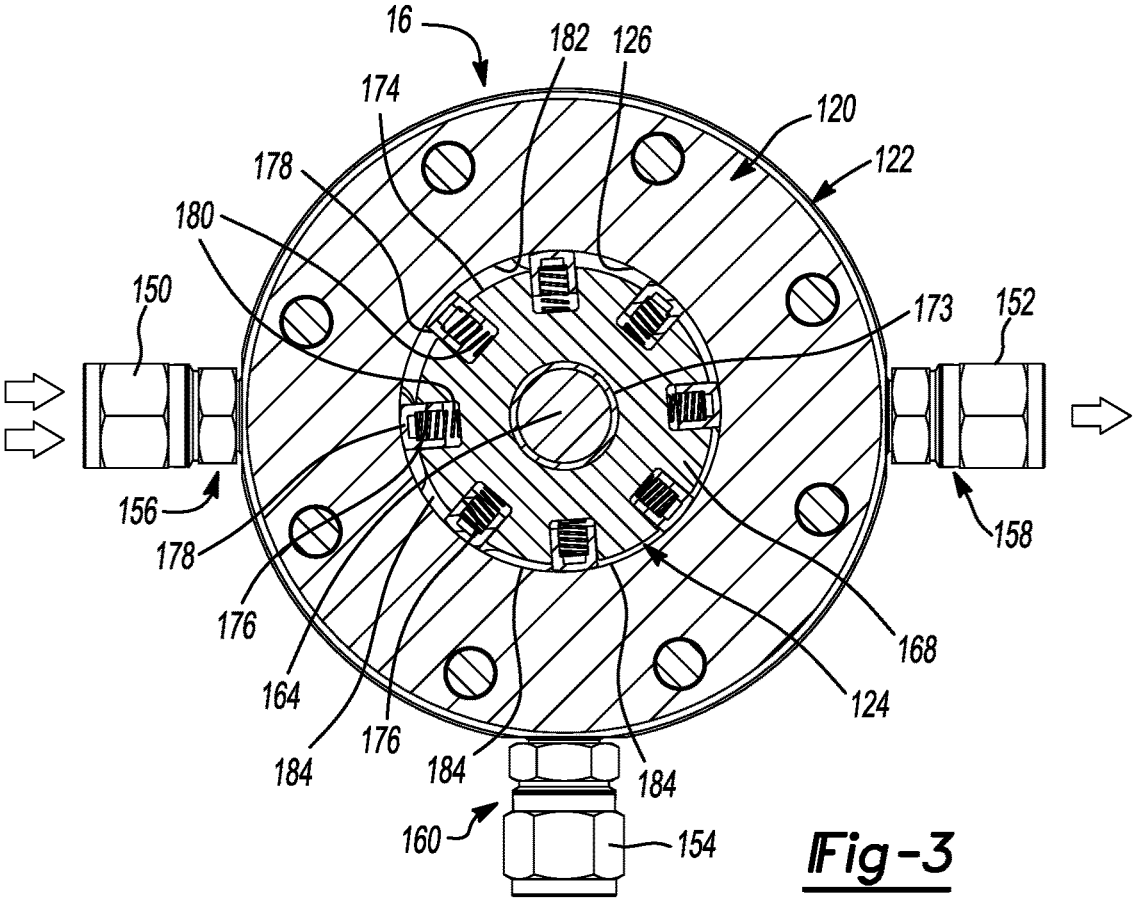
FIG. 3 is a cross-sectional view of a pump of the climate control system of FIG. 1.
Figure 4:
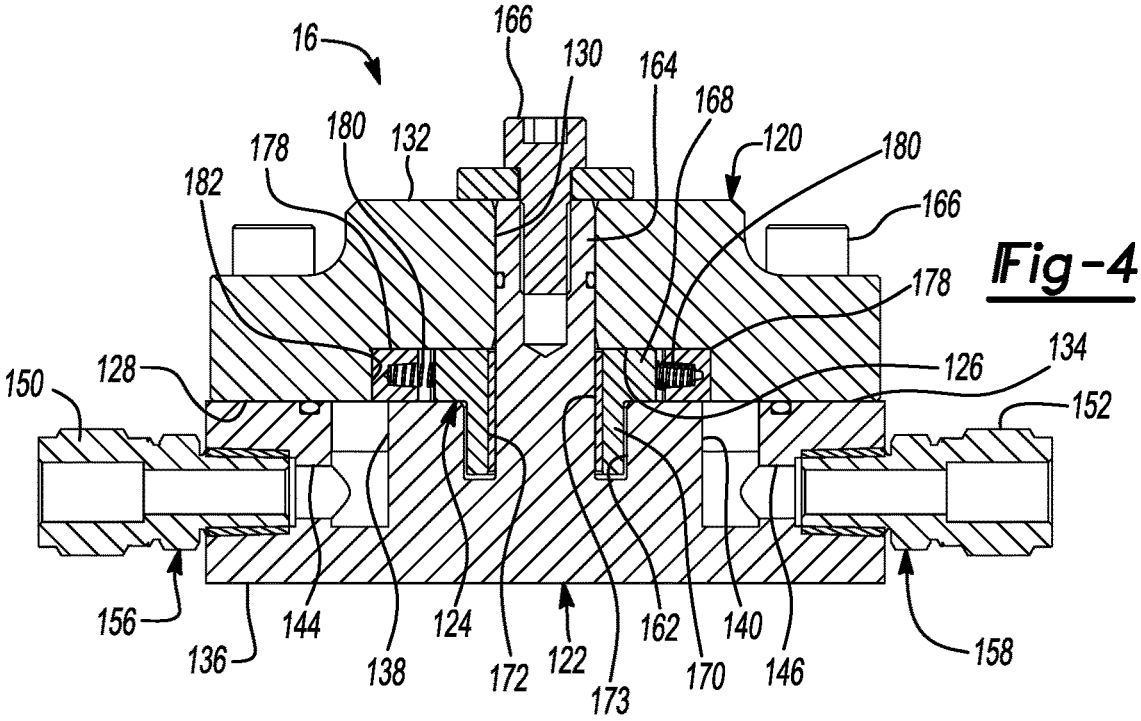
FIG. 4 is another cross-sectional view of the pump.
Figure 5:
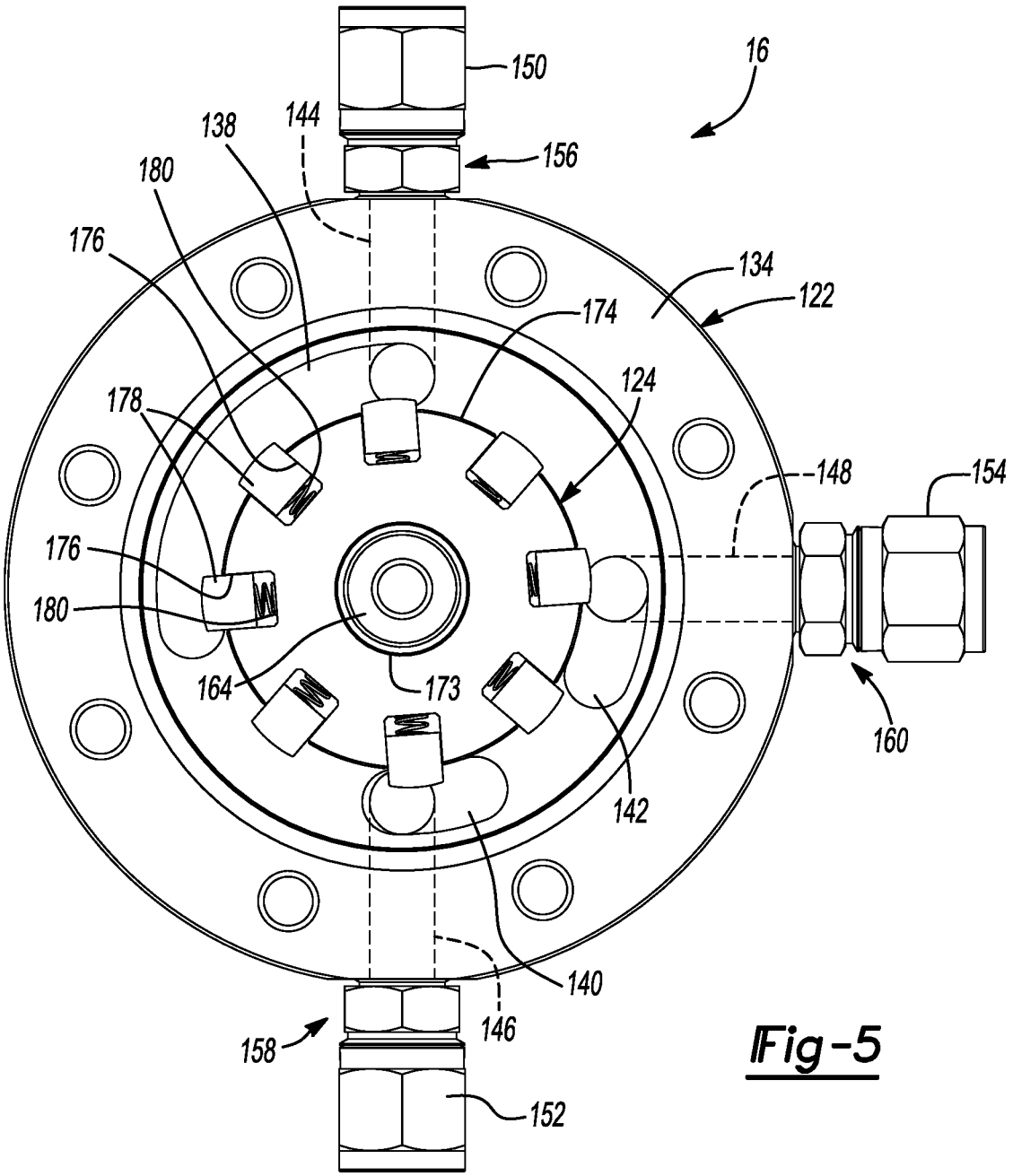
FIG. 5 is a top view of a lower body and rotor of the pump.

Referring now to FIGS. 3-5, the pump 16 may be a rotary vane pump and may be powered only by a pressure differential between fluid upstream of the pump 16 and fluid in the second working fluid flow path 24. It will be appreciated, however, that the pump 16 could be any suitable type of pump, and in some embodiments, could be powered by its own dedicated electric motor or any other power source.

The pump 16 depicted in FIGS. 3-5 includes an upper body 120, a lower body 122 and a rotor 124. As shown in FIG. 4, the upper body 120 may be a generally cylindrical member including an eccentric recess 126 formed in a first side 128 and a central aperture 130 extending from the eccentric recess 126 through a second side 132. In some embodiments, the recess 126 could be concentric and the aperture 130 may be eccentric.

As shown in FIGS. 4 and 5, the lower body 122 may be a generally cylindrical member including a first side 134 and a second side 136. First, second and third blind apertures or recesses 138, 140, 142 (FIG. 5) may be formed in the first side 134. First, second and third ports 144, 146, 148 (FIG. 5) may communicate with and extend radially outward from a corresponding one of the first, second and third recesses 138, 140, 142. First, second and third fittings 150, 152, 154 may engage the first, second and third ports 144, 146, 148, respectively. The first port 144 and first fitting 150 may define an inlet 156 to the pump 16 that may be fluidly coupled to an outlet of the first heat exchanger 14 (as shown in FIG. 1). The second port 146 and second fitting 152 may define a first outlet 158 of the pump 16 that may be fluidly coupled to the expansion device 18 via the second working fluid flow path 24 (as shown in FIG. 1). The third port 148 and third fitting 154 may define a second outlet 160 of the pump 16 that may be fluidly coupled to the compressed-fluid inlet 62 of the compressor 12 via the first working fluid flow path 22 (as shown in FIG. 1).

An annular recess 162 (FIG. 4) may extend axially into the first side 134 of the lower body 122 between the first, second and third recesses 138, 140, 142. A pin 164 may extend axially upward from the annular recess 162 and may extend through the recess 126 of the upper body 120 and sealingly engage the central aperture 130 of the upper body 120. A plurality of fasteners 166 (FIG. 4) may engage the upper and lower bodies 120, 122 to fix the upper and lower bodies 120, 122 relative to each other.

As shown in FIG. 4, the rotor 124 may include a generally disk-shaped body 168, an annular hub 170 extending from the body 168, and a central aperture 172 extending through the body 168 and the annular hub 170. The annular hub 170 may extend into the annular recess 162 of the lower body 122. The pin 164 may extend through central aperture 172 of the rotor 124 and may cooperate with a bearing 173 to rotatably support the rotor 124. The body 168 of the rotor 124 may be received in the eccentric recess 126 of the upper body 120 and may be rotatable therein relative to the upper and lower bodies 120, 122.

As shown in FIGS. 3 and 5, the body 168 of the rotor 124 may include an outer periphery 174 having a plurality of radially extending slots 176 formed therein. The rotor 124 may include a plurality of spring-loaded vanes 178, each of which may slidably engage a corresponding one of the slots 176. Springs 180 may bias the vanes 178 radially outward into engagement with a circumferential wall 182 of the eccentric recess 126 of the upper body 120. A pocket 184 (FIG. 3) is formed between each of the vanes 178 that moves with the rotor 124 from the inlet 156 to the second outlet 160. Fluid enters one of the pockets 184 from the inlet 156 and pushes the rotor 124 as it expands therein while moving toward the first outlet 158. A first portion of the fluid in the pocket 184 is pumped out of the first outlet 158 as the pocket 184 passes the first outlet 158, and a second portion of the fluid remains in the pocket 184 until it is pumped out of the second outlet 160 when the pocket 184 reaches the second outlet 160.

With reference to FIGS. 1-5, operation of the fluid circuit 10 will be described in detail. As described above, suction-pressure working fluid in the suction chamber 50 may be drawn into the fluid pockets between the wraps 80, 92 of the orbiting and non-orbiting scrolls 74, 76 and compressed therein to a discharge pressure that is higher than the suction pressure. From the fluid pockets, the compressed working fluid may flow into the discharge chamber 48 and may be discharged from the compressor 12 through the discharge fitting 54. From the discharge fitting 54, the compressed working fluid may flow to the first heat exchanger 14. In the first heat exchanger 14, the compressed working fluid may be cooled by rejecting heat to ambient air or some other fluid or heat sink. From the first heat exchanger 14, the working fluid may flow to the inlet 156 of the pump 16. The pump 16 may route a first portion of the compressed working fluid to the first working fluid flow path 22 and route a second portion of the compressed working fluid to the second working fluid flow path 24.

As described above, the pump 16 may be powered solely by the pressure differential between the inlet 156 and the first outlet 158. A fluid pressure downstream of the first outlet 158 of the pump 16 may be lower than a fluid pressure upstream of the inlet 156 of the pump 16. This pressure differential causes some of the fluid in one of the pockets 184 between the inlet 156 and the first outlet 158 to be drawn out of the first outlet 158, while higher pressure fluid from the inlet 156 flows into other pockets 184 that are in communication with the inlet 156. This flow into the pump 16 through the inlet 156 and out of the pump 16 through the first outlet 158 causes rotation of the rotor in a clockwise direction (relative to the view shown in FIG. 3). As each pocket 184 passes by the first outlet 158, some of the fluid in that pocket 184 will exit the pump 16 through the first outlet 158 and some of the fluid in that pocket 184 will remain in the compression pocket 184 until the pocket 184 moves into communication with the second outlet 160, where some or all of the fluid remaining in that pocket 184 will be forced out of the pump 16 through the second outlet 160 at a pressure that is higher than the fluid pressures upstream of the inlet 156 and downstream of the first outlet 158.

Working fluid that exits the pump 16 through the first outlet 158 may flow through the second working fluid flow path 24 to the expansion device 18 and subsequently to the second heat exchanger 20. In the second heat exchanger 20, the working fluid may absorb heat from a space to be cooled by the fluid circuit 10. From the second heat exchanger 20, suction-pressure working fluid may flow back into the suction chamber 50 of the compressor 12 through the suction inlet fitting 60. From the suction chamber 50, the working fluid may flow back into the compression mechanism 36 to be compressed to a discharge pressure, as described above.

Working fluid that exits the pump 16 through the second outlet 160 may flow through the first working fluid flow path 22 through the check valve 26 and into the compressor 12 through the compressed-fluid inlet 62. A first portion of the compressed working fluid in the compressed-fluid inlet 62 may flow into the fluid cavity 102 in the non-orbiting scroll 76. The compressed working fluid in the fluid cavity 102 may absorb heat from the non-orbiting scroll 76 before flowing to the discharge chamber 48 through the discharge conduit 108. As described above, fluid in the discharge chamber 48 may exit the compressor 12 through the discharge fitting 54 and flow to the first heat exchanger 14.

A second portion of the compressed working fluid in the compressed-fluid inlet 62 may flow into the supply conduit 75 and into the heat exchanger 72. The compressed working fluid in the heat exchanger 72 may absorb heat from the motor assembly 34 before flowing into the discharge chamber 48 through the discharge conduit 77.

In some embodiments, the compressed working fluid entering the compressor 12 through the compressed-fluid inlet 62 may be in a liquid state or a liquid-vapor mixture. Liquid working fluid may evaporate in the fluid cavity 102 or in the heat exchanger 72 as the fluid absorbs heat and may enter the discharge chamber 48 as a vapor. It will be appreciated that the compressed fluid could enter the compressor 12 through the compressed-fluid inlet 62 in a vapor state or a supercritical state.

An amount of fluid that enters the compressor 12 through the compressed-fluid inlet 62 may be controlled by the control valve 30 in the bypass conduit 28. A controller (not shown) may be in electrical communication with the control valve 30 and may cause the control valve 30 to move to any position between fully open and fully closed based on system and/or compressor operating conditions. Such operating conditions could include one or more of a discharge temperature or pressure, a condenser temperature or pressure, a suction temperature or pressure, a temperature of one or more components of the motor assembly 34 or an electric current flowing through one or more components of the motor assembly 34, for example, and/or any other system or compressor operating condition. Placing the control valve 30 in the fully closed position allows all of the fluid that exits the pump 16 through the second outlet 160 to flow through the first working fluid flow path 22 and into the compressed-fluid inlet 62. Placing the control valve 30 in the fully open position allows all of the fluid that exits the pump 16 through the second outlet 160 to flow from the first working fluid flow path 22 through the bypass conduit 28 and into the second working fluid flow path 24 upstream of the expansion device 18. Placing the control valve 30 in any position between the fully closed and fully open positions may allow some portion of the fluid to flow to the compressed-fluid inlet 62 and some portion of the fluid to flow through the bypass conduit 28 to the second working fluid flow path 24.

While the compressor 12 is described above as including the fluid cavity 102 to cool the compression mechanism 36 and the heat exchanger 72 to cool the motor assembly 34, in some embodiments, the compressor 12 may include only one of the fluid cavity 102 or the heat exchanger 72 and not the other. In other embodiments, the compressor 12 could include additional or alternative cavities and/or heat exchangers to cool additional or alternative components of the compressor 12.

Furthermore, while the configuration illustrated in the figures includes fluid flowing through the fluid cavity 102 and the heat exchanger 72 in parallel, in some configurations, the fluid cavity 102 and heat exchanger 72 could be arranged in series so that fluid flows through one of the fluid cavity 102 and the heat exchanger 72 prior to flowing through the other of the fluid cavity 102 and the heat exchanger 72.

Figure 6:
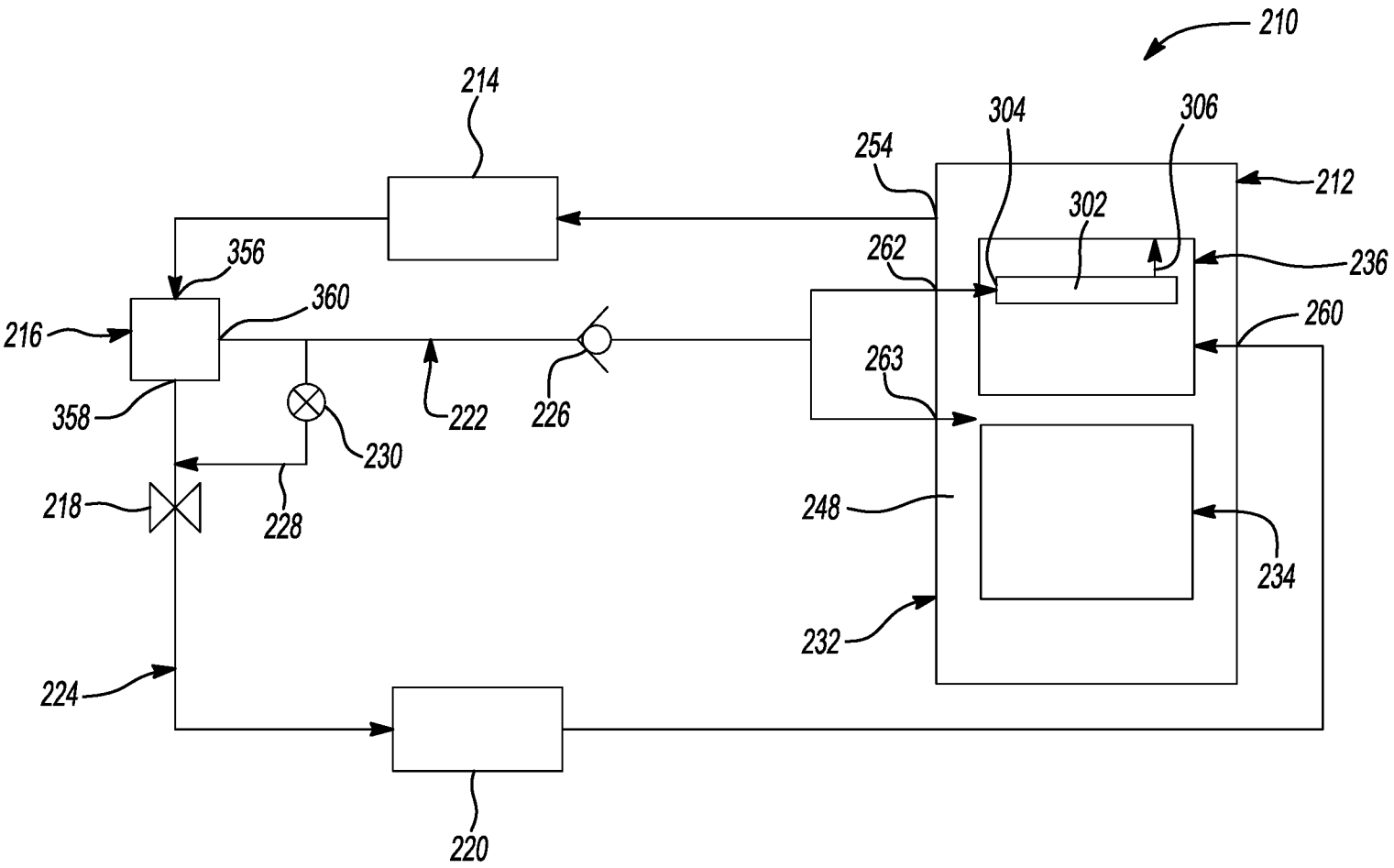
FIG. 6 is a schematic representation of another climate control system according to the principles of the present disclosure.

With reference to FIG. 6, another fluid circuit 210 will be described. The fluid circuit 210 may include a compressor 212, a first heat exchanger 214, a pump 216, an expansion device 218, and a second heat exchanger 220. The compressor 212 may circulate a working fluid (e.g., refrigerant, carbon dioxide, etc.) throughout the fluid circuit 210. The first heat exchanger 214 may operate as a condenser or as a gas cooler and may cool discharge-pressure working fluid received from the compressor 212 by transferring heat from the working fluid to ambient air, for example. The pump 216 may be similar or identical to the pump 16 described above or any other suitable type of pump. Like the pump 16, the pump 216 may include an inlet 356, a first outlet 358 and a second outlet 360. The expansion device 218 (e.g., an expansion valve, a capillary tube, etc.) may be disposed downstream from the first heat exchanger 214 and expands the working fluid passing therethrough. The second heat exchanger 220 may operate as an evaporator. Heat from a space to be cooled may be absorbed by the working fluid in the second heat exchanger 220. The compressor 212 may receive suction-pressure working fluid from the second heat exchanger 220.

The fluid circuit 210 may include first and second working fluid flow paths 222, 224. The first working fluid flow path 222 may extend from the second outlet 360 of the pump 216 to the compressor 212. The second working fluid flow path 224 may extend from the first outlet 358 of the pump 216, through the expansion device 218 and through the second heat exchanger 220 to the compressor 212. The first working fluid flow path 222 may include a check valve 226 between the pump 216 and the compressor 212 to restrict or prevent a reverse-flow condition through the first working fluid flow path 222. A bypass conduit 228 may extend from the first working fluid flow path 222 to the second working fluid flow path 224 and may include a control valve 230 to control fluid flow therethrough. Operation of the control valve 230 may be substantially similar to operation of the control valve 30 described above.

Figure 7:
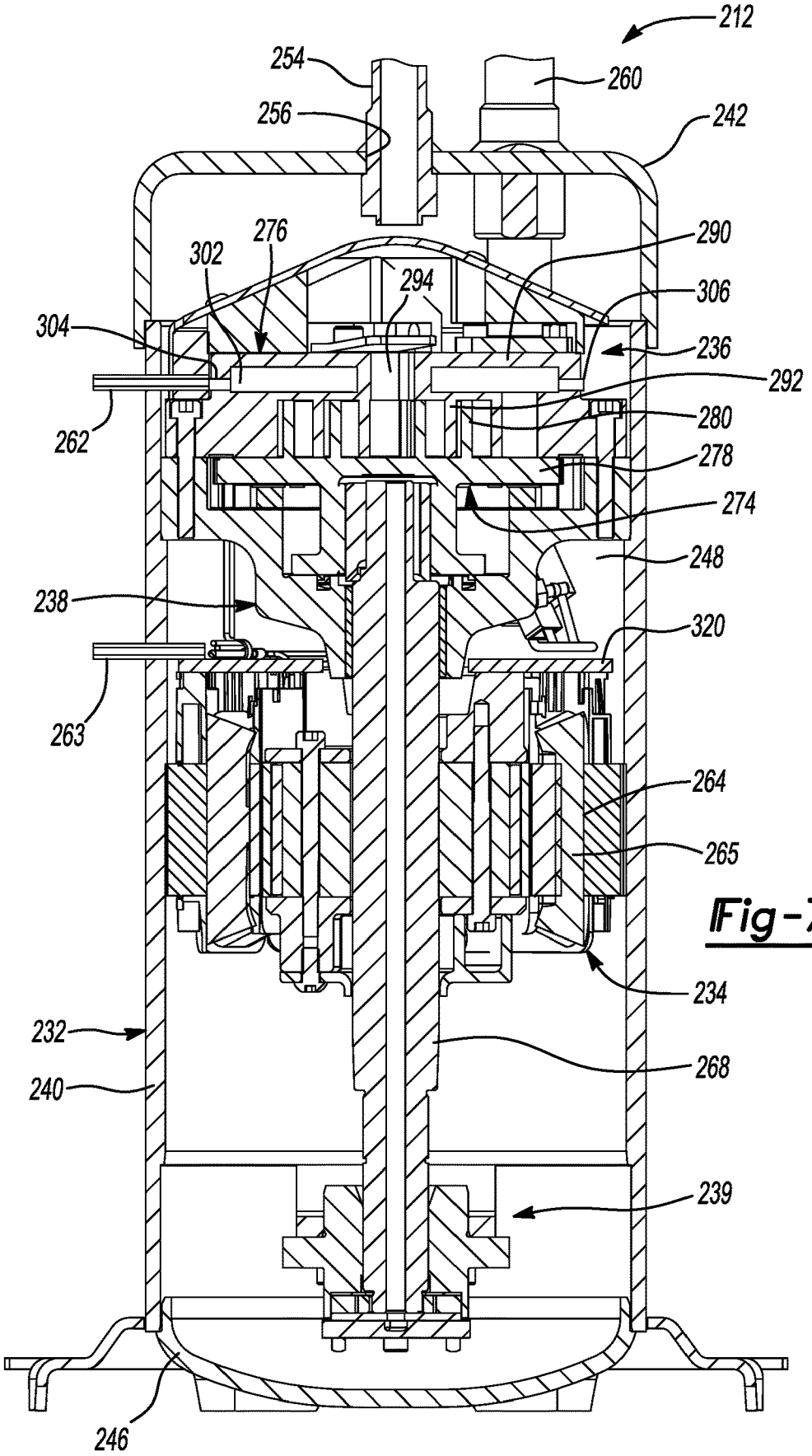
FIG. 7 is a cross-sectional view of a compressor of the climate control system of FIG. 6.

Referring now to FIGS. 6 and 7, the compressor 212 may be a high-side compressor including a hermetic shell assembly 232, a motor assembly 234, a compression mechanism 236, a first bearing assembly 238, and a second bearing assembly 239.

The shell assembly 232 may form a compressor housing and may include a cylindrical shell 240, an end cap 242 at an upper end thereof, and a base 246 at a lower end thereof. The shell 240, end cap 242 and base 246 may cooperate to define a discharge chamber 248 (i.e., working fluid in the chamber 248 may be at a discharge pressure). A discharge fitting 254 may be attached to shell assembly 232 at an opening 256 in the end cap 242. A suction inlet fitting 260 may extend through the shell assembly 232 and may provide fluid communication between the second working fluid flow path 224 and the compression mechanism 236. The suction inlet fitting 260 may be connected to an inlet of the compression mechanism 236 to restrict or prevent discharge-pressure fluid in the discharge chamber 248 from mixing with the suction-pressure fluid in the suction inlet fitting 260. First and second compressed-fluid inlets 262, 263 may extend through the shell assembly 232 and may be in fluid communication with the first working fluid flow path 222 to provide compressed working fluid from the first working fluid flow path 222 to the compressor 212, as will be subsequently described in more detail. In some embodiments, the first and second compressed-fluid inlets 262, 263 could be combine as one single inlet through the shell assembly 232 of the compressor 212 and could split off from each other inside of the shell assembly 232.

Like the compression mechanism 36, the compression mechanism 236 may include an orbiting scroll 274 and a non-orbiting scroll 276. The structure and function of the scrolls 274, 276 may be generally similar to that of the scrolls 74, 76 described above, apart from any exceptions noted below and/or shown in the figures. Therefore, similar structures and functions will not be described again in detail. Briefly, the orbiting scroll 274 may include an end plate 278 having a spiral wrap 280 extending therefrom. A drive shaft 268 may drivingly engage the orbiting scroll 274 for orbital motion relative to the non-orbiting scroll 276.

The non-orbiting scroll 276 may include an end plate 290 and a spiral wrap 292 projecting downwardly from the end plate 290. The spiral wrap 292 may meshingly engage the spiral wrap 280 of the orbiting scroll 274, thereby creating a series of moving fluid pockets (compression pockets) defined by the spiral wraps 280, 292 and end plates 278, 290. Orbital motion of the orbiting scroll 274 may draw suction-pressure fluid from the suction inlet fitting 260 into the fluid pockets. The fluid pockets may decrease in volume as they move from a radially outer position (e.g., at a suction pressure) to a radially inner position (e.g., at a discharge pressure that is higher than the suction pressure) throughout a compression cycle of the compression mechanism 236. At the radially inner position, compressed working fluid exits the compression mechanism 236 through a discharge passage 294 and flows into the discharge chamber 248 and subsequently out of the compressor 212 through the discharge fitting 254.

The end plate 290 may include a fluid cavity 302 (shown schematically in FIGS. 6 and 7). The fluid cavity 302 can be an annular cavity, for example, and may include an inlet 304 and an outlet 306. The inlet 304 may be fluidly connected to the first compressed-fluid inlet 262 to allow compressed working fluid to flow from the first working fluid flow path 222 to the fluid cavity 302. The outlet 306 may be in fluid communication with the discharge chamber 248 to allow working fluid to flow out of the fluid cavity 302 to the discharge chamber 248 and subsequently out of the compressor 212 through the discharge fitting 254.

The motor assembly 234 and the first and second bearing assemblies 238, 239 can be generally similar in structure and function as the motor assembly 34 and first and second bearing assemblies 38, 39 described above. A working-fluid distribution member 320 (FIGS. 7 and 8) may be attached to a stator 264, motor windings 265, the first bearing assembly 238, the shell 240 and/or any other suitable location. The working-fluid distribution member 320 may receive compressed working fluid from the second compressed-fluid inlet 263 and may distribute the compressed working fluid over one or more components of the motor assembly 234, one or more bearings, one or more driveshaft counterweights and/or any other components.

Figure 8:
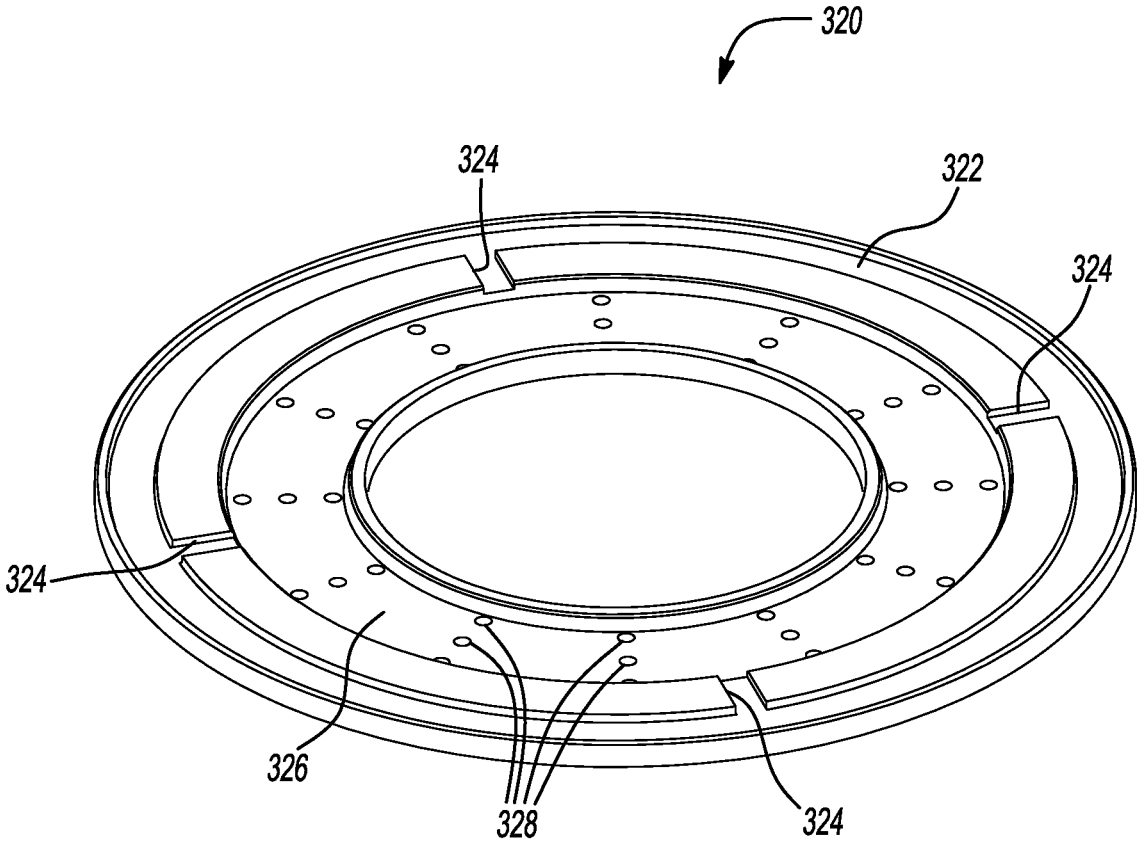
FIG. 8 is a perspective view of a fluid distributor of the compressor of FIG. 7.

As shown in FIG. 8, the working-fluid distribution member 320 can be an annular disk-shaped member having an outer circumferential groove 322, a plurality of radially extending grooves 324, and a central recess 326. The recess 326 may include a plurality of apertures 328 extending therethrough. Compressed working fluid may be received in the outer circumferential groove 322 from the second compressed-fluid inlet 263. From the outer circumferential groove 322, the working fluid may flow into the recess 326 through the radially extending grooves 324. The working fluid in the recess 326 may flow through the apertures 328 and may fall (under the force of gravity) onto one or more components of the motor assembly 234 to cool the one or more components of the motor assembly 234, one or more bearings, one or more driveshaft counterweights and/or any other components.

With reference to FIGS. 6 and 7, operation of the fluid circuit 210 will be described in detail. As described above, suction-pressure working fluid in the suction inlet fitting 260 may be drawn into the fluid pockets between the wraps 280, 292 of the orbiting and non-orbiting scrolls 274, 276 and compressed therein to a discharge pressure that is higher than the suction pressure. From the fluid pockets, the compressed working fluid may flow into the discharge chamber 248 and may be discharged from the compressor 212 through the discharge fitting 254. From the discharge fitting 254, the compressed working fluid may flow to the first heat exchanger 214. In the first heat exchanger 214, the compressed working fluid may be cooled by rejecting heat to ambient air or some other fluid or heat sink. From the first heat exchanger 214, the working fluid may flow to the inlet 356 of the pump 216. The pump 216 may route a first portion of the compressed working fluid to the first working fluid flow path 222 and route a second portion of the compressed working fluid to the second working fluid flow path 224.

Working fluid that exits the pump 216 through the first outlet 358 may flow through the second working fluid flow path 224 to the expansion device 218 and subsequently to the second heat exchanger 220. In the second heat exchanger 220, the working fluid may absorb heat from a space to be cooled by the fluid circuit 210. From the second heat exchanger 220, suction-pressure working fluid may flow back into the compression mechanism 236 of the compressor 212 through the suction inlet fitting 260.

Working fluid that exits the pump 216 through the second outlet 360 may flow through the first working fluid flow path 222 through the check valve 226 and into the compressor 212 through either the first or second compressed-fluid inlets 262, 263. That is, a first portion of the compressed working fluid in the first working fluid flow path 222 may flow through the first compressed-fluid inlet 262 and into the fluid cavity 302 in the non-orbiting scroll 276. The compressed working fluid in the fluid cavity 302 may absorb heat from the non-orbiting scroll 276 before flowing to the discharge chamber 248 through the outlet 306. As described above, fluid in the discharge chamber 248 may exit the compressor 212 through the discharge fitting 254 and flow to the first heat exchanger 214.

A second portion of the compressed working fluid in the first working fluid flow path 222 may flow through the second compressed-fluid inlet 263 to the working-fluid distribution member 320. As described above, the working-fluid distribution member 320 may distribute working fluid onto one or more components of the motor assembly 234, one or more bearings, one or more driveshaft counterweights and/or any other components and absorb heat therefrom. While absorbing heat from one or more of these components, the working fluid may evaporate and mix with discharge-pressure working fluid in the discharge chamber 248 and may subsequently exit the compressor 212 through the discharge fitting 254.

An amount of fluid that enters the compressor 212 through the compressed-fluid inlets 262, 263 may be controlled by the control valve 230 in the bypass conduit 228. A controller (not shown) may be in electrical communication with the control valve 230 and may move the control valve 230 to any position between fully open and fully closed based on system and/or compressor operating conditions, as described above. In some embodiments, one or more additional control valves may be provided in the first working fluid flow path 222 upstream of the first and/or second compressed-fluid inlets 262, 263 to control flow rates through the first and/or second compressed-fluid inlets 262, 263.

Figure 9:
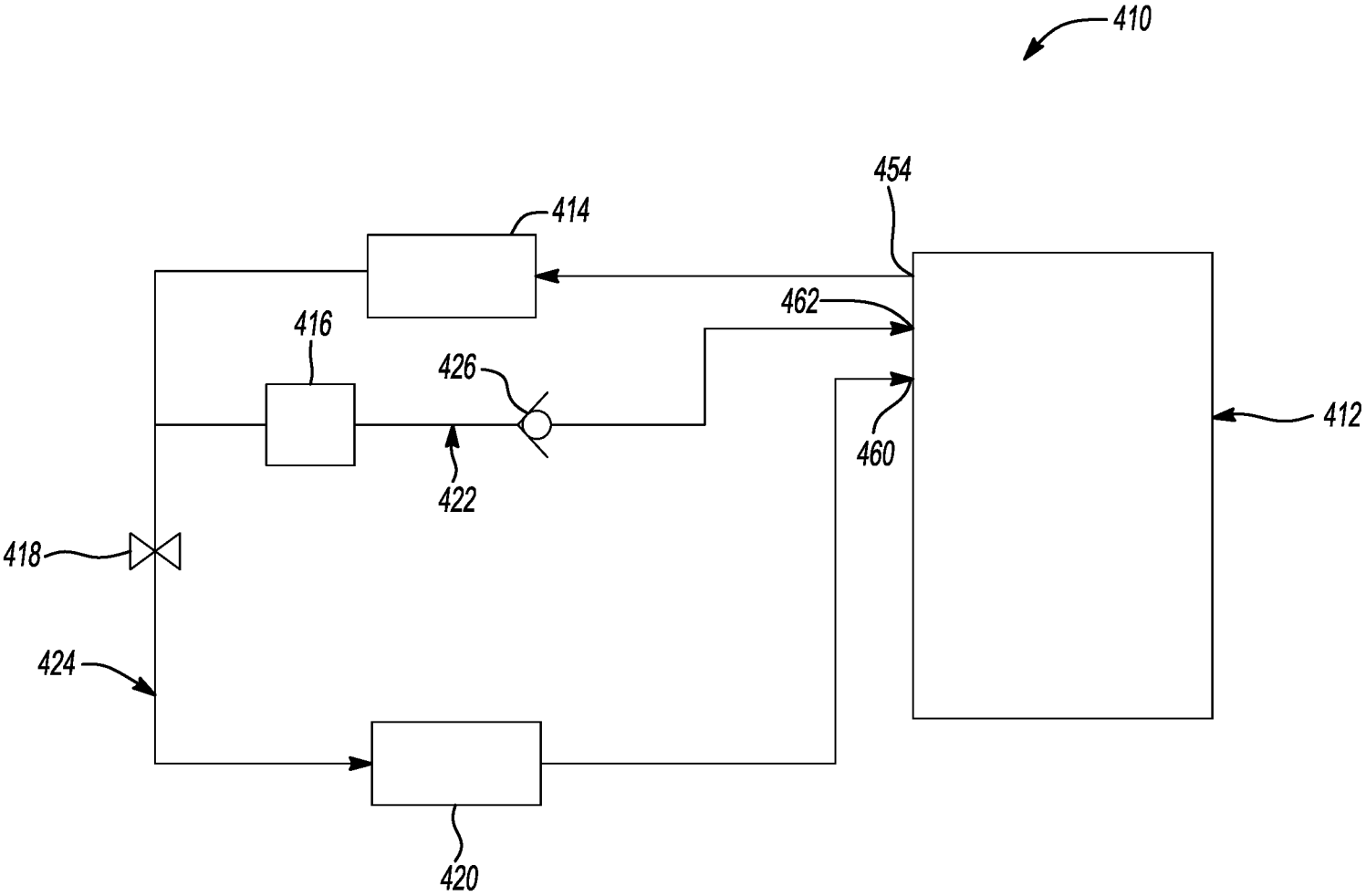
FIG. 9 is a schematic representation of another climate control system according to the principles of the present disclosure.

With reference to FIG. 9, another fluid circuit 410 is provided that may include a compressor 412, a first heat exchanger 414, an electric pump 416, an expansion device 418, a second heat exchanger 420, and first and second working fluid flow path 422, 424. The structure and function of the compressor 412 may be similar or identical to that of either of the compressors 12, 212 described above or any other suitable type of compressor. The first and second heat exchangers 414, 420 and the expansion device 418 may be substantially similar to the heat exchangers 14, 20 and expansion device 18 described above. Accordingly, similar features will not be described again in detail.

The first working fluid flow path 422 may extend between the electric pump 416 and a compressed fluid inlet 462 of the compressor 412. A check valve 426 may be disposed between the electric pump 416 and the compressed fluid inlet 462 and may restrict or prevent a reverse-flow condition through the first working fluid flow path 422. The electric pump 416 may control fluid flow through the first working fluid flow path 422. The second working fluid flow path 424 may extend between the expansion device 418 and a suction inlet fitting 460 of the compressor 412.

With continued reference to FIG. 9, operation of the fluid circuit 410 will be described in detail. As described above, suction-pressure working fluid may be compressed inside the compressor 412 to a discharge pressure that is higher than the suction pressure. The compressed working fluid may be discharged from the compressor 412 through a discharge fitting 454. From the discharge fitting 454, the compressed working fluid may flow into the first heat exchanger 414. In the first heat exchanger 414, the compressed working fluid may be cooled by rejecting heat to ambient air or some other fluid or heat sink.

In response to compressor or system operating conditions, a controller (not shown) may actuate the electric pump 416 to draw a first portion of the working fluid flowing from the first heat exchanger 414 into the first working fluid flow path 422. A second portion of the working fluid may flow from the first heat exchanger 414, through the expansion device 418, and through the second working fluid flow path 424.

When the electric pump 416 is not operating, all or substantially all of the working fluid may bypass the first working fluid flow path 422 and flow from the first heat exchanger 414 into the second working fluid flow path 424. In some embodiments, the controller may modulate the electric pump 416 and/or vary a speed of the pump to regulate an amount of working fluid that is pumped through the first working fluid flow path 422.

Figure 10:
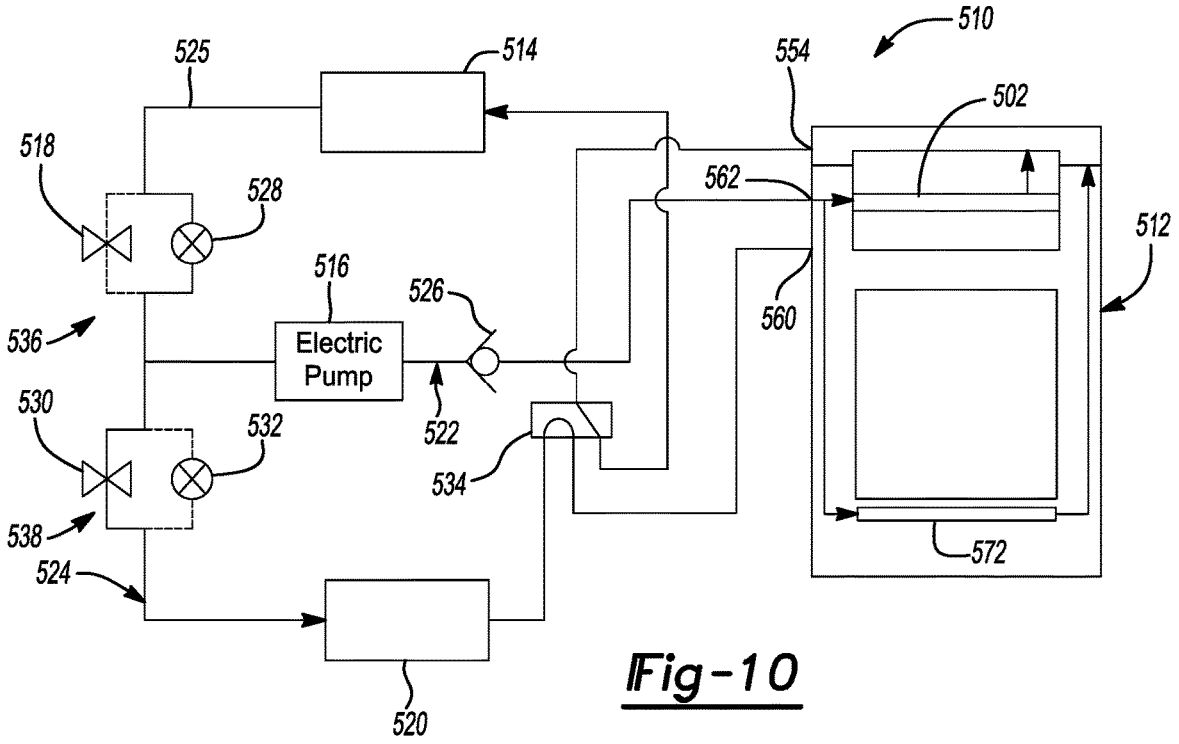
FIG. 10 is a schematic representation of another climate control system operating in a cooling mode.
Figure 11:
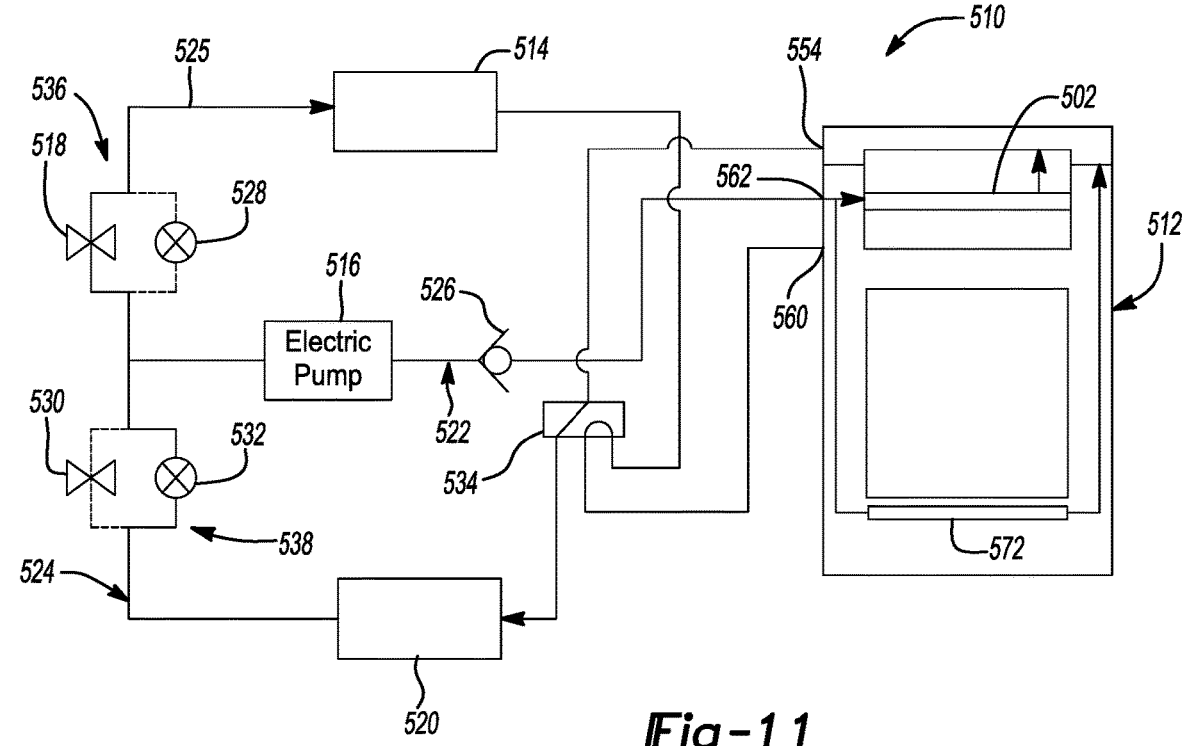
FIG. 11 is a schematic representation of the climate control system of FIG. 10 operating in a heating mode.

With reference to FIGS. 10 and 11, another fluid circuit 510 will be described. The fluid circuit 510 may include a compressor 512, a reversing device 534, a first heat exchanger 514, an electric pump 516, a second heat exchanger 520, a first valve grouping 536, and a second valve grouping 538. The fluid circuit 510 may be a heat pump system operable in a cooling mode (FIG. 10) and a heating mode (FIG. 11). The structure and function of the compressor 512 may be similar or identical to either of the compressors 12, 212 described above or any other suitable type of compressor.

The reversing device 534 may be a four-way valve and may be in communication with a controller (not shown). The controller may switch the reversing device 534 between a first position (FIG. 10) corresponding to the cooling mode and a second position corresponding to the heating mode (FIG. 11) and control a direction of working fluid flow through the fluid circuit 510.

In the cooling mode, the first heat exchanger 514 may operate as a condenser or as a gas cooler and may cool discharge-pressure working fluid received from the compressor 512 by transferring heat from the working fluid to ambient air, for example. In the heating mode, the first heat exchanger 514 may operate as an evaporator.

In the cooling mode, the second heat exchanger 520 may operate as an evaporator and may transfer heat from a space to be cooled to the working fluid in the second heat exchanger 520. In the heating mode, the second heat exchanger 520 may operate as a condenser or as a gas cooler and may transfer heat from working fluid discharged from the compressor 512 to a space to be heated.

The first valve grouping 536 may include a first control valve 528 and a first expansion device 518. The second valve grouping 538 may include a second control valve 532 and a second expansion device 530. The first and second valve groupings 536, 538 may be disposed between the first and second heat exchangers 514, 520. The first valve grouping 536 may be located between the first heat exchanger 514 and a first working fluid flow path 522. The second valve grouping 538 may be located between the second heat exchanger 520 and the first working fluid flow path 522.

The first and second control valves 528, 532 may communicate with a controller (not shown) and may be movable between open and closed positions based on whether the fluid circuit 510 is operating in the cooling mode or the heating mode. In the cooling mode, the first control valve 528 may be in the open position and the second control valve 532 may be in the closed position. Therefore, in the cooling mode, working fluid is allowed to bypass the first expansion device 518, as shown by the dashed lines, and flow through the second expansion device 530. In the heating mode, the first control valve 528 may be in the closed position and the second control valve 532 may be in the open position. Therefore, in the heating mode, working fluid is allowed to bypass the second expansion device 530, as shown by the dashed lines, and flow through the first expansion device 518.

The electric pump 516 may be disposed between the first and second valve groups 536, 538. The electric pump 516 may be similar or identical to the electric pump 416 described above or any other suitable type of pump. The first working fluid flow path 522 may extend between the electric pump 516 and a compressed working fluid inlet 562 of the compressor 512 and may include a check valve 526. A second working fluid flow path 524 may extend between the second valve grouping 538 and the second heat exchanger 520. A third working fluid flow path 525 may extend between the first valve grouping 536 and the first heat exchanger 514.

With reference to FIG. 10, operation of the fluid circuit 510 in the cooling mode will be described in detail. As described above, suction-pressure working fluid may be drawn into the compressor 512 through a suction inlet fitting 560. Inside the compressor 512, the working fluid may be compressed to a discharge pressure and may be discharged from the compressor 512 through a discharge fitting 554. From the discharge fitting 554, the compressed working fluid may flow into the reversing device 534, which may direct the compressed working fluid into the first heat exchanger 514. In the first heat exchanger 514, the compressed working fluid may be cooled by rejecting heat to ambient air or some other fluid or heat sink. From the first heat exchanger 514, all or substantially all of the working fluid may flow into the first control valve 528 and may bypass the first expansion device 518.

When the electric pump 516 is operating, a first portion of the working fluid from the first control valve 528 may be pumped through the first working fluid flow path 522 and into the compressed working fluid inlet 562. From the compressed working fluid inlet 562, the working fluid may flow into one or more heat exchangers 502, 572 to cool one or more compressor components in the manner described above.

A second portion of the working fluid from the first control valve 528 may flow to the second valve grouping 538. As described above, the second control valve 532 may be closed in the cooling mode, and therefore, the working fluid flowing to the second valve grouping 538 may flow through the second expansion device 530. From the second expansion device 530, the working fluid may flow through the second heat exchanger 520, through the reversing device 534 and back into the compressor 512 through the suction inlet fitting 560. When the electric pump 516 is not operating, all or substantially all of the working fluid may flow from the first control valve 528 to the second working fluid flow path 524 and may bypass the first working fluid flow path 522.

With reference to FIG. 11, operation of the fluid circuit 510 in the heating mode will be described in detail. As described above, suction-pressure working fluid may be drawn into the compressor 512 through the suction inlet fitting 560. Inside the compressor 512, the working fluid may be compressed to a discharge pressure and may be discharged from the compressor 512 through the discharge fitting 554. From the discharge fitting 554, the compressed working fluid may flow into the reversing device 534, which may direct the compressed working fluid into the second heat exchanger 520. In the second heat exchanger 520, heat from the compressed working fluid may be transferred to a space to be heated.

From the second heat exchanger 520, all or substantially all of the working fluid may flow through the second control valve 532 and may bypass the second expansion device 530. When the electric pump 516 is operating, a first portion of the working fluid from the second control valve 532 may be pumped through the first working fluid flow path 522 and into the compressed working fluid inlet 562. From the compressed working fluid inlet 562, the working fluid may flow into one or more heat exchangers 502, 572 to cool one or more compressor components in the manner described above.

A second portion of the working fluid from the second control valve 532 may flow to the first valve grouping 536. As described above, the first control valve 528 may be closed in the heating mode, and therefore, the working fluid flowing to the first valve grouping 536 may flow through the first expansion device 518. From the first expansion device 518, the working fluid may flow through the first heat exchanger 514, through the reversing device 534 and back into the compressor 512 through the suction inlet fitting 560. When the electric pump 516 is not operating, all or substantially all of the working fluid may flow from the second control valve 532 to the third working fluid flow path 525 and may bypass the first working fluid flow path 522.

Figure 12:
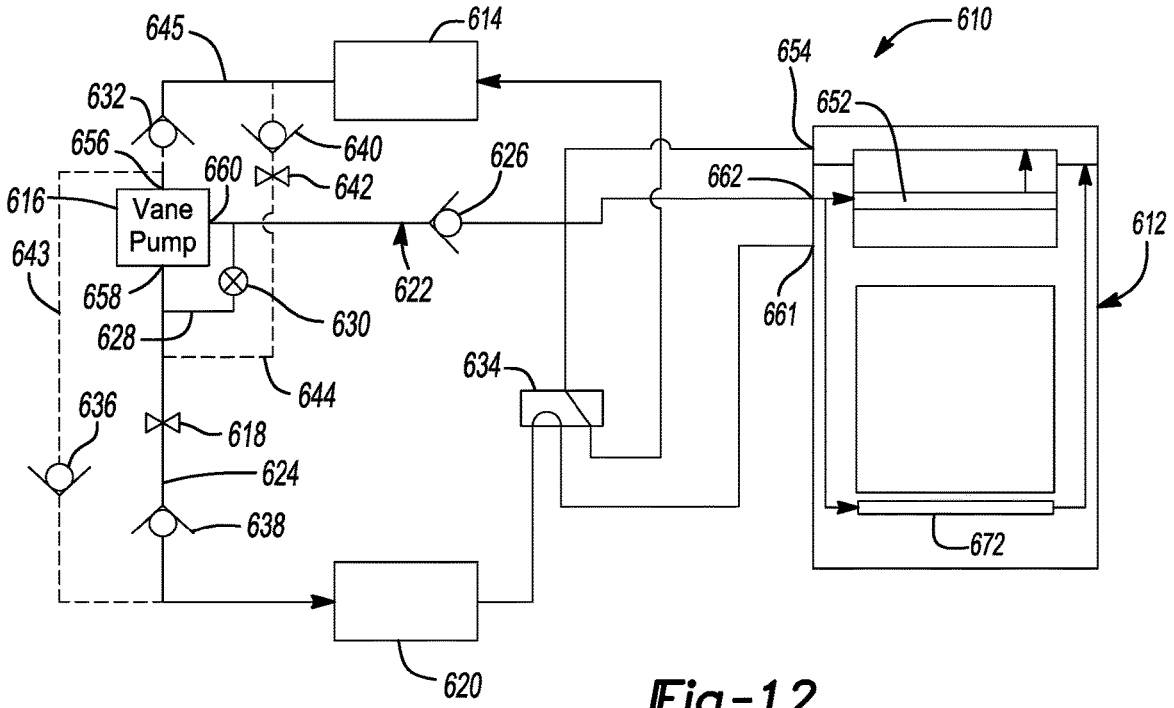
FIG. 12 is a schematic representation of another climate control system operating in a cooling mode.
Figure 13:
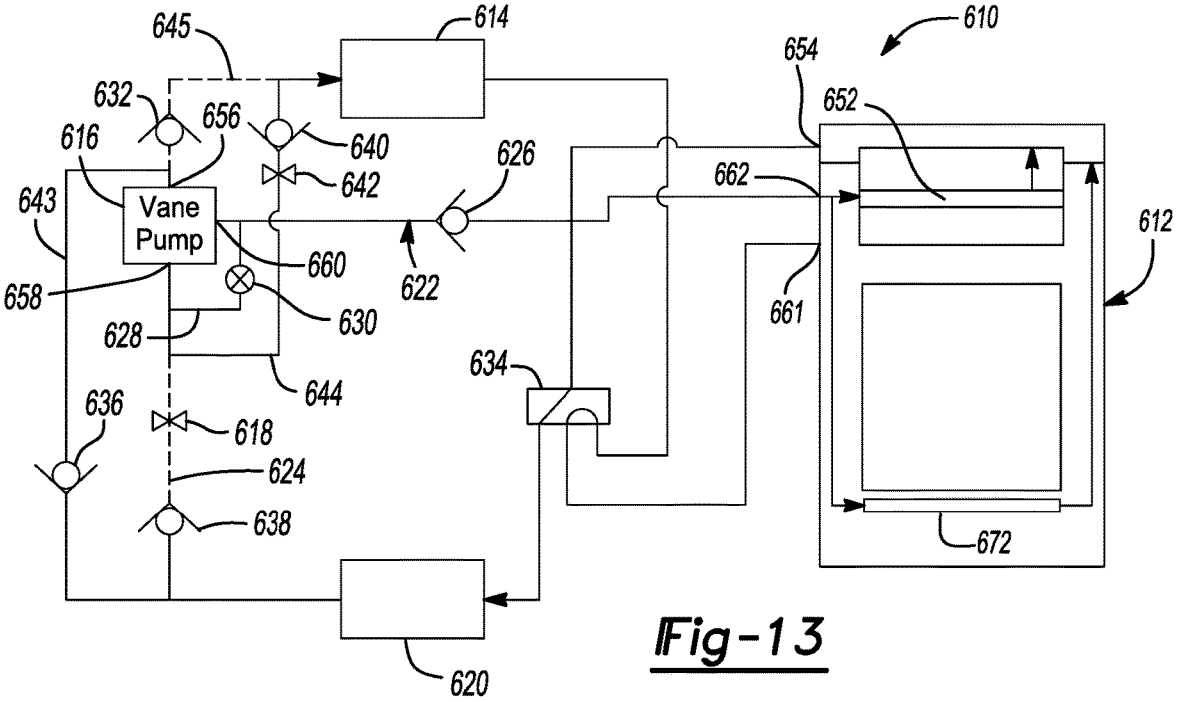
FIG. 13 is a schematic representation of the climate control system of FIG. 12 operating in a heating mode.

With reference to FIGS. 12 and 13, another fluid circuit 610 will be described. The fluid circuit 610 may be a heat pump system operable in a cooling mode (FIG. 12) and a heating mode (FIG. 13). The fluid circuit 610 may include a compressor 612, a reversing device 634, a first heat exchanger 614, a second heat exchanger 620, a pump 616, a first working fluid flow path 622, a second working fluid flow path 624, a third working fluid flow path 645, a fourth working fluid flow path 643, and a fifth working fluid flow path 644.

The structure and function of the compressor 612 may be similar or identical to that of either of the compressors 12, 212 described above or any other suitable type of compressor.

The pump 616 may be similar or identical to the pump 16. The pump 616 may include an inlet 656, a first outlet 658 and a second outlet 660. The structure and function of the first and second heat exchangers 614, 620 may be similar or identical to that of the first and second heat exchangers 414, 420 described above.

With reference to FIG. 12, operation of the fluid circuit 610 in the cooling mode will be described in detail. As described above, suction-pressure working fluid may be drawn into the compressor 612 through a suction inlet fitting 661. Inside the compressor 612, the working fluid may be compressed and discharged from the compressor 612 through a discharge fitting 654 to the reversing device 634. The reversing device 634 may direct the working fluid to the first heat exchanger 614. In the first heat exchanger 614, the compressed working fluid may be cooled by rejecting heat to ambient air or some other fluid or heat sink.

From the first heat exchanger 614, the working fluid may flow through the third working fluid flow path 645 and through a first check valve 632. A fourth check valve 640 may prevent working fluid in the third working fluid flow path 645 from flowing into and through the fifth working fluid flow path 644, as shown by the dashed lines in the fifth working fluid flow path 644. From the first check valve 632, the working fluid may flow into the inlet 656 of the pump 616. Because pressure upstream of the inlet 656 of the pump 616 is higher than pressure downstream of the first outlet 658, working fluid is prevented from flowing from the second working fluid flow path 624 to the third working fluid flow path 645 via the fifth working fluid flow path 644, as shown by the dashed lines in the fifth working fluid flow path 644. The pump 616 may route a first portion of the compressed working fluid to the first working fluid flow path 622 and may route a second portion of the compressed working fluid to the second working fluid flow path 624.

Working fluid that exits the pump 616 through the first outlet 658 may flow through the first expansion device 618, through the second working fluid flow path 624, through the fifth check valve 638, and subsequently into the second heat exchanger 620. As shown by the dashed lines in the fourth working fluid flow path 643, working fluid may be restricted or prevented from flowing through the fourth working fluid flow path 643 due to a pressure differential of the working fluid at a location near the inlet 656 of the pump 616 and at a location near the second heat exchanger 620. Working fluid may also be restricted or prevented from flowing through the fifth working fluid flow path 644, as shown by the dashed lines in the fifth working fluid flow path 644, due to the pressure differential of the working fluid at a location near the second heat exchanger 620 and at a location near the first heat exchanger 614.

In the second heat exchanger 620, the working fluid may absorb heat from a space to be cooled by the fluid circuit 610. From the second heat exchanger 620, suction-pressure working fluid may flow through the reversing device 634 and back into the compressor 612 through the suction inlet fitting 661.

Working fluid that exits the pump 616 through the second outlet 660 may flow through the first working fluid flow path 622, through the second check valve 626, and subsequently into the compressor 612 through the compressed-fluid inlet 662. From the compressed-fluid inlet 662, the working fluid may flow into one or more heat exchangers 652, 672 to cool one or more compressor components in the manner described above.

An amount of fluid that enters the compressor 612 through the compressed-fluid inlet 662 may be controlled by a control valve 630 in a bypass conduit 628. A controller (not shown) may be in communication with the control valve 630 and may cause the control valve 630 to move to any position between fully open and fully closed based on system and/or compressor operating conditions, as described above.

By placing the control valve 630 in the fully closed position, all or substantially all of the fluid that exits the pump 616 through the second outlet 660 may flow through the first working fluid flow path 622 and into the compressed-fluid inlet 662. By placing the control valve 630 in the fully open position, all or substantially all of the fluid may exit the pump 616 through the second outlet 660 and flow from the first working fluid flow path 622, through the bypass conduit 628, and into the second working fluid flow path 624 upstream of the first expansion device 618. By placing the control valve 630 in any position between the fully closed and fully open position, a portion of the fluid may flow to the compressed-fluid inlet 662 and a portion of the fluid may flow through the bypass conduit 628. From the bypass conduit 628, the working fluid may flow through the first expansion device 618, through second working fluid flow path 624, through the fifth check valve 638, through the second heat exchanger 620 and reversing device 634 and subsequently into the suction inlet fitting 661 of the compressor 612.

With reference to FIG. 13, operation of the fluid circuit 610 in the heating mode will be described in detail. As described above, suction-pressure working fluid may be drawn into the compressor 612 through the suction inlet fitting 661. Inside the compressor 612, the working fluid may be compressed and discharged from the compressor 612 through the discharge fitting 654. From the discharge fitting 654, the working fluid may flow through the reversing device 634 and into the second heat exchanger 620, wherein heat from the working fluid may be transferred to a space to be heated by the fluid circuit 610.

From the second heat exchanger 620 all or substantially all of the working fluid may flow through the fourth working fluid flow path 643, through the third check valve 636, and subsequently into the inlet 656 of the pump 616. The fifth check valve 638 may restrict or prevent the working fluid from flowing to the first expansion device 618 as shown by the dashed lines therebetween. The first check valve 632 may restrict or prevent the working fluid in the fourth working fluid flow path 643 from flowing directly into the third working fluid flow path 645 as shown by the dashed lines therein.

Working fluid that exits the pump 616 through the first outlet 658 may flow through the fifth working fluid flow path 644, through a second expansion device 642, through the fourth check valve 640, and subsequently into the first heat exchanger 614. Working fluid may be restricted or prevented from flowing through the third working fluid flow path 645, as shown by the dashed lines in the third working fluid flow path 645, due to the pressure differential of the working fluid at a location near the first heat exchanger 614 and at a location near the inlet 656 of the pump 616.

From the first heat exchanger 614, suction-pressure working fluid may flow through the reversing device 634. From the reversing device 634, suction-pressure working fluid may flow back into the compressor 612 through the suction inlet fitting 661.

Working fluid that exits the pump 616 through the second outlet 660 may flow through the first working fluid flow path 622, through the second check valve 626, and subsequently into the compressor 612 through the compressed-fluid inlet 662. From the compressed-fluid inlet 662, the working fluid may flow into one or more heat exchangers 652, 672 to cool one or more compressor components in the manner described above.

As described above, an amount of fluid that enters the compressor 612 through the compressed-fluid inlet 662 may be controlled by the control valve 630 in the bypass conduit 628.

Figure 14:
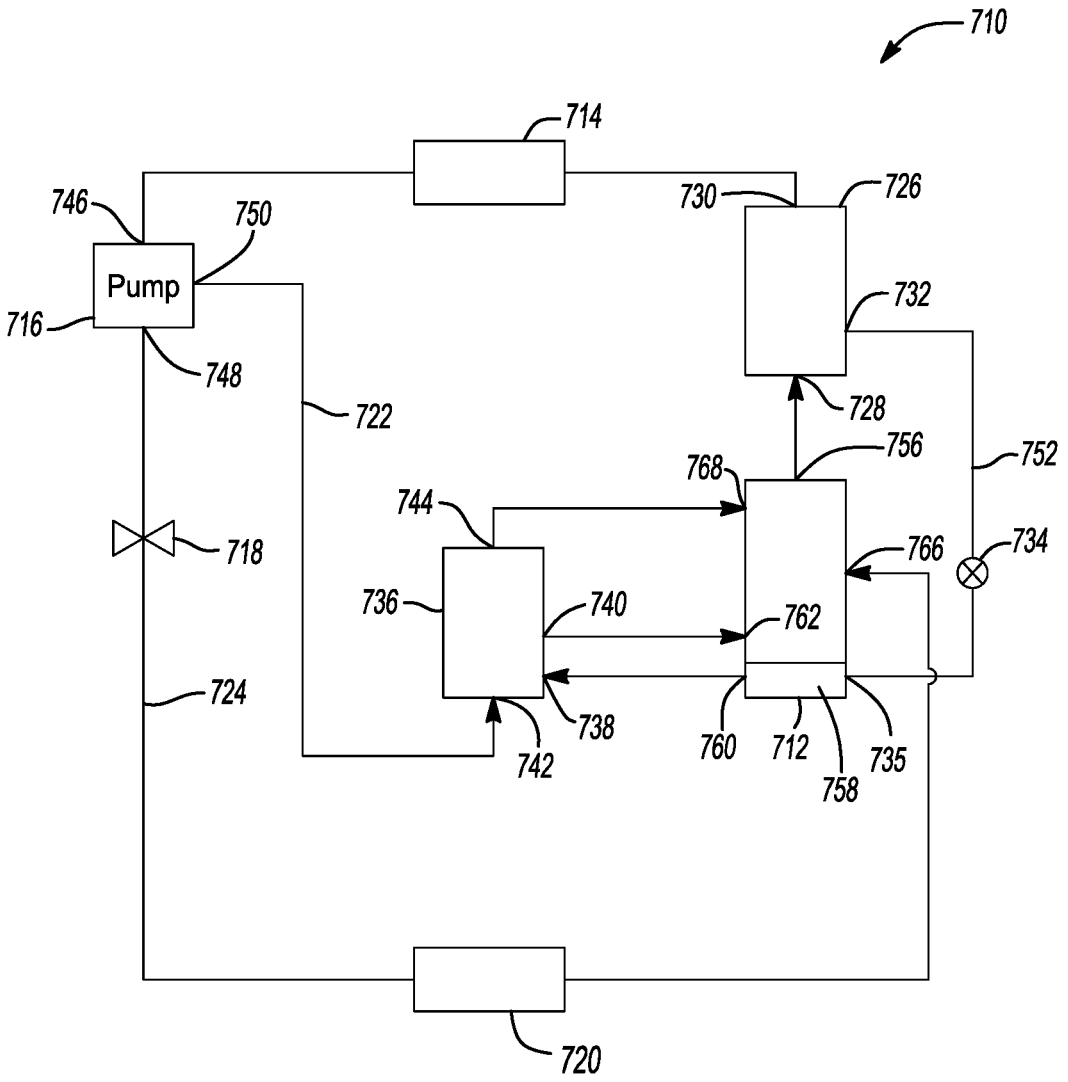
FIG. 14 is a schematic representation of another climate control system according to the principles of the present disclosure.

With reference to FIG. 14 another fluid circuit 710 will be described. The fluid circuit 710 may include a compressor 712, a first heat exchanger 714, a pump 716, an expansion device 718, a second heat exchanger 720, an oil separator 726 and a third heat exchanger 736.

The structure and function of the compressor 712 may be similar or identical to the compressor 12, 212 described above or any other suitable type of compressor. The compressor 712 may include a discharge fitting 756, a suction inlet fitting 766, a first oil inlet fitting 735, a second oil inlet fitting 762, an oil outlet fitting 760, a compressed fluid inlet 768, and an oil sump 758 disposed in a lower portion of the compressor 712.

The structure and function of the first heat exchanger 714, pump 716, expansion device 718, and second heat exchanger 720 may be similar or identical to that of the first heat exchanger 14, pump 16, expansion device 18, and second heat exchanger 20 described above. Accordingly, similar features will not be described again in detail.

The oil separator 726 may include an inlet 728 and first and second outlets 730, 732. The inlet 728 may be in fluid communication with the discharge fitting 756 of the compressor 712. The first outlet 730 of the oil separator 726 may be in fluid communication with the first heat exchanger 714. The second outlet 732 of the oil separator 726 may be in fluid communication with the oil inlet fitting 735 of the compressor 712 by an oil-return line 752. The oil inlet fitting 735 may be in fluid communication with the oil sump 758. A control valve 734 may be located on the oil-return line 752 and may control a flow of lubricant therethrough.

The third heat exchanger 736 may include an oil inlet fitting 738 and an oil outlet fitting 740. The oil inlet fitting 738 may be in fluid communication with the oil outlet fitting 760 of the compressor 712, while the oil outlet fitting 740 may be in communication with the oil inlet fitting 762 of the compressor 712. The third heat exchanger 736 may also include a working fluid inlet 742 and a working fluid outlet 744. The working fluid inlet 742 may be in communication with a second outlet 750 of the pump 716. The working fluid outlet 744 of the third heat exchanger 736 may be in communication with the compressed fluid inlet 768 of the compressor 712. In some embodiments, the working fluid outlet 744 may, additionally or alternatively, be in communication with the inlet 728 of the oil separator 726 and/or the suction inlet fitting 766 of the compressor 712.

The fluid circuit 710 may also include a first working fluid flow path 722 and a second working fluid flow path 724. The first working fluid flow path 722 may extend between the second outlet 750 of the pump 716 and the working fluid inlet 742 of the third heat exchanger 736. The second working fluid flow path 724 may extend between the first outlet 748 of the pump 716 and the suction inlet fitting 766 of the compressor 712.

With reference to FIG. 14, operation of the fluid circuit 710 will be described in detail. As described above, suction-pressure working fluid may be drawn into the compressor 712 through the suction inlet fitting 766, compressed to a discharge pressure, and discharged from the compressor 712 through the discharge fitting 756. From the discharge fitting 756, the compressed working fluid may flow into the inlet 728 of the oil separator 726, wherein a majority of the oil may be separated from the working fluid. The working fluid may flow from the oil separator 726 through the first outlet 730 and flow into the first heat exchanger 714. When the oil disposed within the oil separator 726 reaches a predetermined level, the control valve 734 may open to allow oil to flow through the oil-return line 752 to the oil inlet fitting 735 of the compressor 712 and subsequently into the oil sump 758 of the compressor 712.

In the first heat exchanger 714, the compressed working fluid may be cooled by rejecting heat to ambient air or some other fluid or heat sink. From the first heat exchanger 714, the working fluid may flow to an inlet 746 of the pump 716. Working fluid that exits the pump 716 through the second outlet 750 may flow through the first working fluid flow path 722 and into the working fluid inlet 742 of the third heat exchanger 736 to absorb heat from oil flowing therethrough. The working fluid may exit the third heat exchanger 736 and flow into the compressor 712 through the compressed fluid inlet 768 and may subsequently cool one or more compressor components. In other embodiments, the working fluid may exit the third heat exchanger 736 and flow into the compressor 712 through the suction inlet fitting 766. In other embodiments, the working fluid may exit the third heat exchanger 736 and flow into a discharge line downstream of the discharge fitting 756, into a discharge muffler of the compressor 712, or into the oil separator 726.

Working fluid that exits the pump 716 through a first outlet 748 may flow through the expansion device 718, through the second working fluid flow path 724 and into the second heat exchanger 720. In the second heat exchanger 720, the working fluid may absorb heat from a space to be cooled by the fluid circuit 710. From the second heat exchanger 720, suction-pressure working fluid may flow back into the suction chamber 764 of the compressor 712 through the suction inlet fitting 766.

Figure 15:
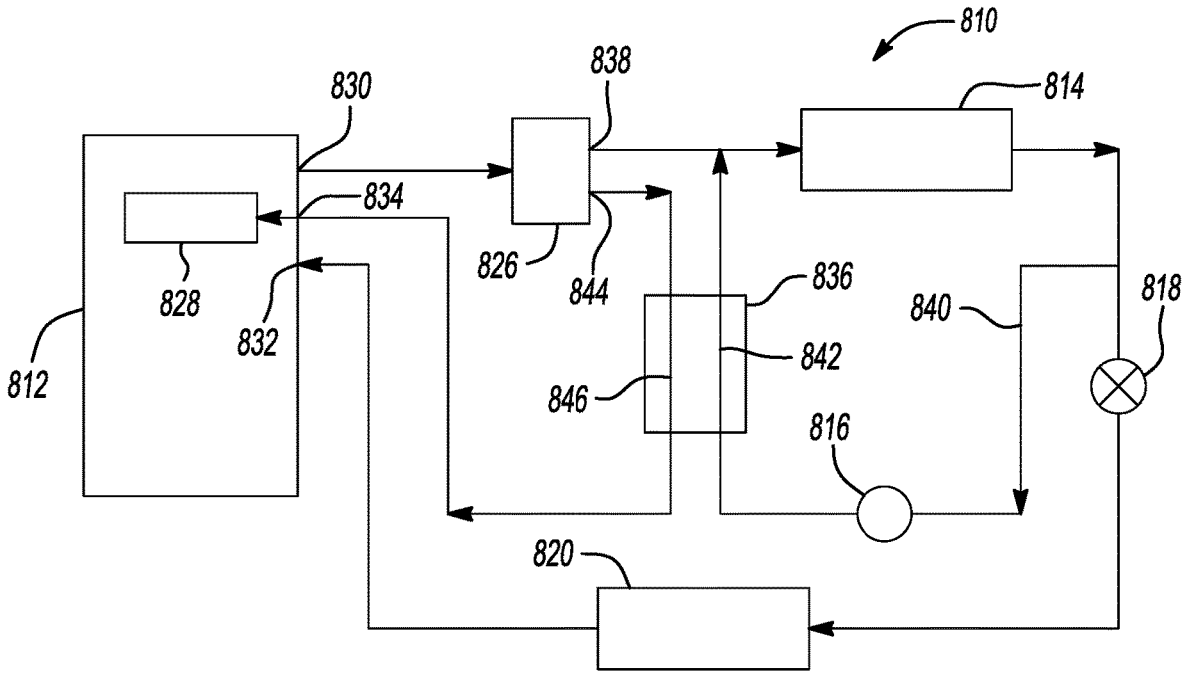
FIG. 15 is a schematic representation of another climate control system according to the principles of the present disclosure.

With reference to FIG. 15, another fluid circuit 810 is provided that may include a compressor 812, a first heat exchanger 814, a pump 816, an expansion device 818, a second heat exchanger 820, an oil separator 826 and a third heat exchanger 836. In some configurations, the fluid circuit 810 could be a heat pump operable in a heating mode and in a cooling mode. The compressor 812 may include a compression mechanism 828, a discharge fitting 830, a suction inlet fitting 832 and an oil inlet fitting 834. The compression mechanism 828 could be a scroll-type compression mechanism, for example. The compression mechanism 828 may compress working fluid received from the suction inlet fitting 832 and discharge compressed working fluid through the discharge fitting 830. The oil inlet fitting 834 may be in fluid communication with the compression mechanism 828 so that oil from the oil inlet fitting 834 may be injected into the compression mechanism 828 (e.g., into one or more compression pockets of the compression mechanism 828).

After being discharged from the compressor 812, a mixture of oil and working fluid may flow into the oil separator 826, where the oil is separated from the working fluid. The working fluid may exit the oil separator 826 through a working fluid outlet 838 and may flow into the first heat exchanger 814. In the first heat exchanger 814, heat from the working fluid may be transferred to air blown across the first heat exchanger 814 by a fan (not shown), for example. At least a portion of the working fluid exiting the first heat exchanger 814 may flow through the expansion device 818 and subsequently through the second heat exchanger 820 (where the working fluid absorbs heat) and back into the compressor 812 through the suction inlet fitting 832. During operation of the pump 816, a portion of the work fluid exiting the first heat exchanger 814 may flow into a recirculation flow path 840 in fluid communication with a working fluid conduit 842 of the third heat exchanger 836. From the third heat exchanger 836, the working fluid may flow back into the first heat exchanger 814.

Oil may exit the oil separator 826 through an oil outlet 844 and flow into an oil conduit 846 of the third heat exchanger 836. Working fluid in the working fluid conduit 842 may absorb heat from oil in the oil conduit 846. After exiting the third heat exchanger 836, the cooled oil may be injected into the compression mechanism 828 through the oil inlet fitting 834, as described above. The oil injected into the compression mechanism 828 may cool and lubricate the compression mechanism 828.

While the compressor 812, oil separator 826, third heat exchanger 836 and the pump 816 are all shown in FIG. 15 as separate components, in some configurations, one of more of the components can be integrated with each other. For example, the oil separator 826 can be disposed within the compressor 812 or externally mounted thereto; the third heat exchanger 836 can be attached to the oil separator 826; and/or the pump 816 could be integrated with the third heat exchanger 836 and/or the oil separator 826.

Figure 16:
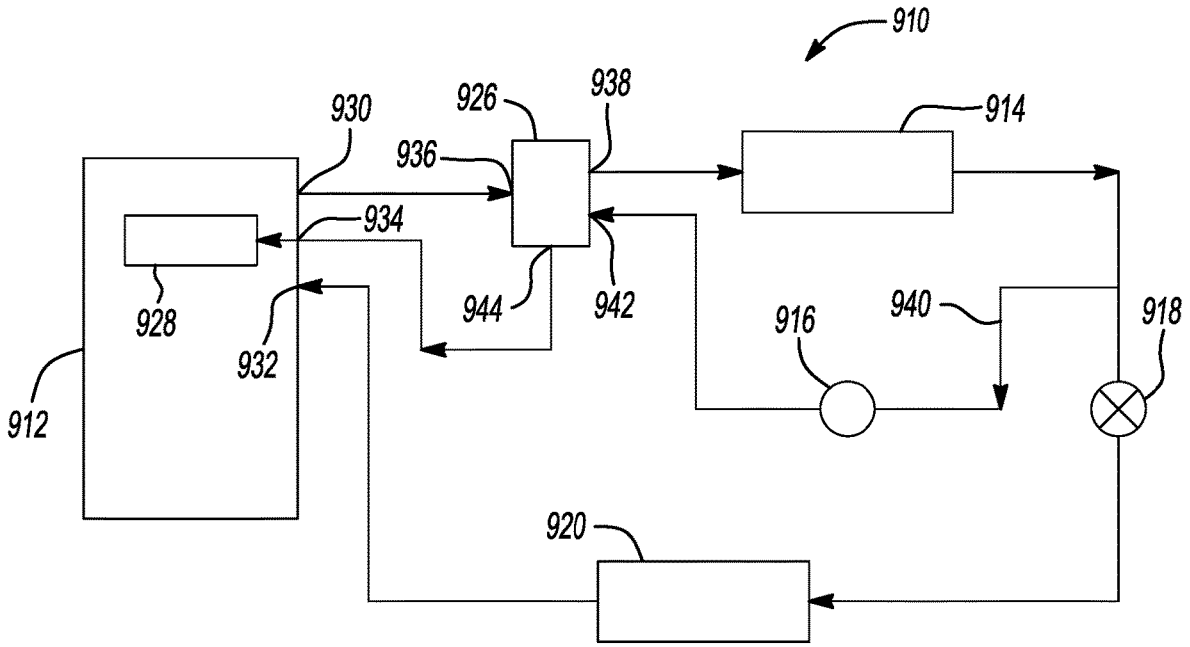
FIG. 16 is a schematic representation of another climate control system according to the principles of the present disclosure.

With reference to FIG. 16, another fluid circuit 910 is provided that may include a compressor 912, a first heat exchanger 914, a pump 916, an expansion device 918, a second heat exchanger 920 and an oil separator 926. In some configurations, the fluid circuit 910 could be a heat pump operable in a heating mode and in a cooling mode. The compressor 912 may include a compression mechanism 928, a discharge fitting 930, a suction inlet fitting 932 and an oil inlet fitting 934. The compression mechanism 928 could be a scroll-type compression mechanism, for example. The compression mechanism 928 may compress working fluid received from the suction inlet fitting 932 and discharge compressed working fluid through the discharge fitting 930. The oil inlet fitting 934 may be in fluid communication with the compression mechanism 928 so that oil from the oil inlet fitting 934 may be injected into the compression mechanism 928 (e.g., into one or more compression pockets of the compression mechanism 928).

After being discharged from the compressor 912, a mixture of oil and working fluid may flow into the oil separator 926 through a first inlet 936. Oil is separated from the working fluid in the oil separator 926. The working fluid may exit the oil separator 926 through a working fluid outlet 938 and may flow into the first heat exchanger 914. In the first heat exchanger 914, heat from the working fluid may be transferred to air blown across the first heat exchanger 914 by a fan (not shown), for example. At least a portion of the working fluid exiting the first heat exchanger 914 may flow through the expansion device 918 and subsequently through the second heat exchanger 920 (where the working fluid absorbs heat) and back into the compressor 912 through the suction inlet fitting 932.

During operation of the pump 916, a portion of the work fluid exiting the first heat exchanger 914 may flow into a recirculation flow path 940 in fluid communication with a second inlet 942 of the oil separator 926. Since the working fluid in the recirculation flow path 940 is cooled in the first heat exchanger 914 prior to entering the oil separator 926 through the second inlet 942, the working fluid from the second inlet 942 can absorb heat from oil in the oil separator 926 by direct contact. After absorbing heat from the oil, the working fluid may exit the oil separator 926 through the working fluid outlet 938. Cooled oil may exit the oil separator 926 through an oil outlet 944 and may be injected into the compression mechanism 928 through the oil inlet fitting 934, as described above. The oil injected into the compression mechanism 928 may cool and lubricate the compression mechanism 928.

While the compressors 12, 212, 412, 512, 612, 712, 812 and 912 are described above as being hermetic scroll compressors, it will be appreciated that the principles of the present disclosure are applicable to any type of compressor including reciprocating compressors, rotary vane compressors, linear compressors, or open-drive compressors, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell including a first inlet, a second inlet, and an outlet;

a first scroll including a first end plate and a first spiral wrap;

a second scroll including a second end plate and a second spiral wrap, the first and second spiral wraps cooperating to define a series of moving compression pockets therebetween, the moving compression pockets decrease in volume as the moving compression pockets move from a radially outer position to a radially inner position, the moving compression pockets receiving working fluid from the first inlet at the radially outer position and providing working fluid to the outlet at the radially inner position, the second end plate including a fluid cavity receiving working fluid from the second inlet and fluidly isolated from working fluid within the moving compression pockets, wherein the shell defines a discharge chamber in which the first and second scrolls are disposed, wherein the moving compression pockets at the radially inner position are in fluid communication with the discharge chamber, and wherein the fluid cavity in the second end plate is in fluid communication with the discharge chamber;

a motor assembly disposed within the discharge chamber; and a working-fluid-distribution member disposed within the discharge chamber and including a plurality of apertures through which working fluid falls onto the motor assembly.

2. The compressor of claim 1, wherein the shell includes a third inlet that opens into the discharge chamber and provides working fluid to the working-fluid-distribution member.

3. The compressor of claim 2, wherein the working-fluid-distribution member is an annular disk-shaped member having an outer circumferential groove, a plurality of radially extending grooves, and a central recessed portion, wherein the radially extending grooves extend from the outer circumferential groove to the central recessed portion, and wherein the plurality of apertures are disposed in the central recessed portion.

4. The compressor of claim 3, wherein the working-fluid-distribution member is mounted to a stator of the motor assembly.

5. A compressor comprising:

a shell defining a discharge chamber and including a first inlet fluidly isolated from the discharge chamber, a second inlet in fluid communication with the discharge chamber, and an outlet in fluid communication with the discharge chamber;

an orbiting scroll including a first end plate and a first spiral wrap; and a non-orbiting scroll including a second end plate and a second spiral wrap, the second end plate including a discharge passage, the first and second spiral wraps cooperating to define a series of moving compression pockets therebetween, the moving compression pockets decrease in volume as the moving compression pockets move from a radially outer position to a radially inner position, the moving compression pockets receiving working fluid from the first inlet at the radially outer position, the moving compression pockets providing working fluid to the outlet via the discharge passage at the radially inner position, the second end plate including an annular fluid cavity surrounding the discharge passage and receiving working fluid from the second inlet, the fluid cavity fluidly isolated from working fluid within the moving compression pockets;

a motor assembly driving the orbiting scroll; and a working-fluid-distribution member including a plurality of apertures through which working fluid falls onto the motor assembly.

6. The compressor of claim 5, wherein:

the motor assembly is disposed within the discharge chamber, the working-fluid-distribution member is disposed within the discharge chamber, and the orbiting and non-orbiting scrolls are disposed within the discharge chamber.

7. The compressor of claim 5, wherein the shell includes a third inlet that opens into the discharge chamber and provides working fluid to the working-fluid-distribution member.

8. The compressor of claim 5, wherein the working-fluid-distribution member is mounted to a stator of the motor assembly.

9. The compressor of claim 5, wherein the working-fluid-distribution member is an annular disk-shaped member having an outer circumferential groove, a plurality of radially extending grooves, and a central recessed portion, wherein the radially extending grooves extend from the outer circumferential groove to the central recessed portion, and wherein the plurality of apertures are disposed in the central recessed portion.

* * * * *